US006004733A

United States Patent [19]

Ishii et al.

[11] Patent Number: 6,004,733

[45] Date of Patent: Dec. 21, 1999

[54] PACKAGED ROLL-SHAPED SILVER HALIDE PHOTOSENSITIVE MATERIAL

[75] Inventors: Yukio Ishii, Odawara; Mutsuo Akao, Minami-Ashigara; Masatoshi Kato, Kanagawa-ken; Hiroyuki Osanai, Minami-Ashigara, all of Japan

[73] Assignee: Fuji Photo Film Co., Ltd., Kanagawa-ken, Japan

[21] Appl. No.: 08/814,858

[22] Filed: Mar. 11, 1997

[30] Foreign Application Priority Data

Mar. 11, 1996 [JP] Japan ..... 8-083270
Feb. 28, 1997 [JP] Japan ..... 9-061791

[51] Int. Cl.[6] ..... G03C 3/02

[52] U.S. Cl. ..... 430/501; 396/511; 206/397; 206/455

[58] Field of Search ..... 430/501; 396/511; 206/455, 414, 416, 389, 397, 398

[56] References Cited

U.S. PATENT DOCUMENTS 4,356,224 10/1982 Akao et al. ..... 206/455
4,661,395 4/1987 Akao ..... 428/213
4,762,776 8/1988 Uesawa et al. ..... 430/538
5,312,725 5/1994 Araki et al. ..... 430/523
5,353,933 10/1994 Takahashi et al. ..... 206/398

FOREIGN PATENT DOCUMENTS 3-53243 3/1991 Japan .

OTHER PUBLICATIONS

Research Disclosure, Dec. 1989, pp. 993–994.

*Primary Examiner*—Janis L. Dote
*Attorney, Agent, or Firm*—Sughrue, Mion, Zinn Macpeak & Seas, PLLC

[57] ABSTRACT

A packaged roll-shaped silver halide photosensitive material comprising a winding core, a roll-shaped silver halide photosensitive material wound on the winding core and a packaging material covering the periphery and the both two lateral sides of the roll-shaped silver halide photosensitive material, wherein at least one surface of the three surfaces in the periphery and the both two lateral sides of the roll-shaped silver halide photosensitive material is packaged with a packaging material comprising a combination of a paper material with a pored film, and the water vapor permeability of such packaging material is not less than 5.1 $g/m^2 \cdot 24$ hours. It is possible to prevent deterioration of a roll-shaped silver halide photosensitive material through abnormal sensitization of photographic performance.

14 Claims, 14 Drawing Sheets

PACKAGED ROLL-SHAPED SILVER HALIDE PHOTOSENSITIVE MATERIAL

TECHNICAL FIELD OF THE INVENTION

This invention relates to a packaged silver halide photosensitive material wound in a roll. More particularly, it relates to a packaging material for packaging a silver halide photosensitive material having a pre-set water vapor permeability on a pre-set material for maintaining the silver halide photosensitive material in an optimum state for prolonged time. The term "photosensitive" used herein denotes primarily photographic-photosensitive.

BACKGROUND

The packaging material for a photosensitive material, that is a material whose commercial quality or value is lost on exposure to light, is required to have characteristics of completely interrupting the light (light-shielding properties). In particular, for prolonged storage or transportation of the photosensitive material, the packaging material is required to have various properties for preventing deterioration of the photosensitive material due to fogging, such as light-shielding properties, physical strength or heat-sealing strength. In particular, for storing or transporting a large-format film in a compact state, a packaged roll-shaped photosensitive material having the above properties is employed.

As a packaged roll-shaped photosensitive material, a packaged photosensitive material having a winding core, a roll-shaped photosensitive material wound on the winding core and a light-shielding film covering the peripheral surface and lateral sides of the roll-shaped photosensitive material and having both ends secured to the winding core (JP Patent Kokai JP-A-3-53243). It is stated in this disclosure that the light-shielding film has a transmittance to moisture of 5 g/m$^2$·24 hours or less, that is it has moisture-tightness.

SUMMARY OF THE DISCLOSURE

In the course of the present invention the following problems have been found.

With recent progress in the art including inclusion of a dye in a supporting portion of the roll-shaped photosensitive material (the portion of the photosensitive material other than a photosensitive layer) or inclusion of a dye containing layer, the tendency is towards including various dyes in the supporting portion or towards higher quality or sensitivity of the roll-shaped photosensitive material. If a packaged roll-shaped silver halide photosensitive material, prepared for meeting with such tendency, as disclosed in JP Patent Kokai JP-A-3-53243, is used for prolonged storage of the roll-shaped photosensitive material, especially the roll-shaped silver halide photosensitive material, the photographing performance of the photosensitive material is unusually increased, such that fogging is occasionally produced.

It is a basic object of the present invention to overcome the above-mentioned problem and to provide a packaged roll-shaped photosensitive material enabling prolonged storage of a roll-shaped photosensitive material, especially a roll-shaped silver halide photosensitive material.

Further objects will become apparent in the entire disclosure.

The present invention provides a packaged roll-shaped silver halide photosensitive material comprising a winding core, a roll-shaped silver halide photosensitive material wound on the winding core and a packaging material covering the periphery and both two lateral sides of the roll-shaped silver halide photosensitive material, wherein at least one surface of three surfaces in the periphery and both two lateral sides of the roll-shaped silver halide photosensitive material is packaged with a packaging material comprising a combination of a paper material with a film having pores, termed hereinafter as "pored film", and the water vapor permeability of the packaging material comprising the combination of the paper material with the pored film not less than 5.1 g/m$^2$·24 hours. That is, by using, as a packaging material at least covering one of the periphery and both two lateral sides of the roll-shaped silver halide photosensitive material, a packaging material having water vapor permeability of not less than 5.1 g/m$^2$·24 hours (as measured at a temperature of 40° C. and a relative humidity (RH) of 90% in accordance with JIS Z-0208), it becomes possible to prevent degradation with lapse of time of the roll-shaped silver halide photosensitive material due to unusual sensitization in photographic performance. The effect of the present invention is most acute for a silver halide photosensitive material containing silver chloride, as a silver halide photosensitive material transported or stored in the form of the packaged roll-shaped silver halide photosensitive material according to the present invention, in particular for a large-sized roll-shaped silver halide photosensitive material. The preferred size of the roll-shaped silver halide photosensitive material is not less than 50 cm in length along the length of the winding shaft (width) and not less than 30 cm in winding diameter, that is in diameter with the silver halide photosensitive material placed on the winding shaft.

With the tendency towards inclusion of various dyes in the supporting portion and towards high quality and increased sensitization of the roll-shaped photosensitive material, the latter is highly susceptible to moisture. Our researches have revealed that, if a roll-shaped photosensitive material, especially the silver halide photosensitive material, is packaged in the form of a conventional packaged roll-shaped photosensitive material having light-shielding and moisture-proofing properties, as disclosed in the above-mentioned JP Patent Kokai JP-A-3-53243, the photosensitive material is subjected to unusual sensitization in photographic performance, resulting in fogging. The reason the unusual sensitization in photographic performance is produced, as clarified by our researches, is now explained by referring to the drawings. FIG. 21 schematically shows a layered structure of a typical colored photographic paper sheet as an example of the roll-shaped photosensitive material. The photosensitive layer is made up of six layers, including a protective layer and an intermediate layer. Each layer is applied uniformly highly accurately, with the total thickness being 10 $\mu$m. The light from an emulsified layer enters the color photographic paper sheet via a protective layer 1, a red-sensitive layer 2, an intermediate layer 3, a green-sensitive layer 4, an intermediate layer 5, a blue-sensitive layer 6 and a support (polyethylene layers 7, 9 and a paper layer 8), in this order. Part of reducing substances contained in the supporting portion and in various photosensitive layers in the photosensitive material, such as sulfur, antiseptics and hydrogen generating substances (e.g., aluminum compounds) are vaporized from the supporting portion or the photosensitive layers to be dispersed or diffused into air. In the conventional packaged roll-shaped photosensitive material exhibiting light-shielding properties and moisture-proofness, the reducing substances in the gaseous phase in the roll-shaped photosensitive material is increased in density thus increasing sensitization due to reduction in the various photosensitive layers. Our researches have revealed that increased sensitization due to reduction occurs predominantly in the blue-sensitive layer in the color photographic sheets.

That is, in transportation or storage of a roll-shaped photosensitive material in the form of a packaged roll-shaped photosensitive material having water vapor permeability of not less than 5.1 $g/m^2 \cdot 24$ hours in the packaging material comprising a combination of a paper material with a pored film according to the present invention, the packaged roll-shaped photosensitive material permits the reducing substances present in the gaseous phase in the packaged roll-shaped photosensitive material to be transmitted to outside to prevent the reducing substances in the packaged roll-shaped photosensitive material from being increased in density to prevent reducing sensitization in order to prevent the roll-shaped silver halide photosensitive material from being deteriorated with lapse of time by unusual sensitization in photographic performance.

DESCRIPTION OF THE PREFERRED EMBODIMENTS

The packaging material having transmittance to moisture may be used in any surface or a portion threreof of a peripheral surface and both two (2) lateral sides on the packaged roll-shaped silver halide photosensitive material. Thus the packaging material may be used on a peripheral surface and both lateral sides, the peripheral surface and a lateral side, both lateral sides, only the peripheral surface, only the lateral sides or on portions thereof. As the packaging material with a paper material and a pored film, exhibiting transmittance to moisture, any material derived from a paper material and a pored film having transmittance to moisture may be used. These packaging materials may preferably comprise a combination of a paper material such as natural paper, synthetic paper, and corrugated board sheet, which is a paper or has a quality of a paper, with a pored film such as a perforated film and a fine-pore film, as the packaging material having the transmittance property to moisture. Now, the light-shielding properties may be obtained in any methods from a combination of the paper material with the pored film. In the periphery or the two lateral sides that have no pored film, films that have complete light shielding ability are preferably used to package the silver halide photographic material.

The light-shielding property of the paper material may be obtained in any methods which give necessary light-shielding property to the present invention, such as using the light-shielding property which the paper material itself posseses in nature, piling up in some sheets, containing the light-shielding material in the paper material, and others.

The pored film is preferably colored. The colored film is made by adding to a film the light-shielding material as described later.

In this specification, a pored film is not a light-shielding film since the light passes through the pore of the film even though the film per se used therein, may have contained the light-shielding material.

As the paper material of the packaging material having the transmittance properties to moisture with a paper material and a pored film, corrugated board sheets may be used. The corrugated board sheets are superior in cost, workability, that is ease in cutting, punching or bonding, wide range of working temperatures and recycling properties. Moreover, the corrugated board sheets are superior in shock-absorbing properties and hence desirable as the packaging material for protecting the inside from external shock. As the corrugated board sheets, used as a packaging material for the packaged roll-shaped silver halide photosensitive material according to the present invention, a single-sided corrugated board sheet, a double-sided corrugated board sheet or a double-face double-sided corrugated board sheet may be used. The double-sided corrugated board sheet as shown in FIG. 20 is preferred in view of strength and cost. FIG. 20 shows an example of such double-sided corrugated board sheet in which a fluted corrugated medium 62 is clamped between two liners 61 and the liners 61 are bonded to the corrugated medium 62 with an adhesive 63.

As the flute shape of the corrugated board sheet, an A-flute (height of the flute, 4.5 to 4.7 mm, number of flutes, 34±2 flutes per cm); a B-flute (height of the flute, 2.5 to 2.8 mm, number of flutes, 50±2 flutes per 30 cm); C-flute (height of the flute, 3.5 to 3.8 mm, number of flutes, 40±2 flutes per 30 cm); an E-flute (height of the flute, about 1.1 mm, number of flutes, 93±5 flutes per 30 cm); and No.5 flute (height of flute, 2.0 mm, number of flutes, 62±2 flutes per 30 cm). As examples of overseas producers, an F-flute (USA; height of flute, 5.9 mm, number of flutes, 420/m); a K-flute (Europe; height of flute, 5.9 mm, number of flutes, 85/m); MIDI flutes (height of flute, 0.7 to 2.3 mm, number of flutes, 200 per meter); and JACO to MIDI flutes (height of flutes, 0.7 to 1.1 mm, number of flutes, 350 flutes per meter), may be used. The height of flutes of the corrugated board sheet is preferably not more than 5.0 mm, more preferably not more than 4.0 mm, particularly preferably not more than 3.0 mm and most preferably not more than 2.0 mm. The number of flutes is preferably not less than 30 flutes /30 cm, more preferably not less than 50 flutes /30 cm, particularly preferably not less than 70 flutes /30 cm and most preferably not less than 80 flutes/ 30 cm. The take-up ratio of the corrugated board sheet is preferably not more than 1.60, more preferably not more than 1.50, particularly preferably not more than 1.40 and most preferably not less than 1.30. That is, the smaller height of flute and the larger number of flutes per unit length are desirable. In particular, the E-flute corrugated board sheet is most preferred.

As the liners of the corrugated board sheet, any of the grade AA, grade A, grade B or grade C liners conforming to JIS P 3.902 may be used. Any conventional liner exhibiting light-shielding properties and transmittance to moisture, such as specially prepared high ring crash liner, water-proofed liner, K, K' or K", jutes B, C or C' or interior class D liner, may be used. The basis weight of the liner is preferably not less than 100 $g/m^2$ , more preferably 100 to 200 $g/m^2$, particularly preferably 110 to 170 $g/m^2$ and most preferably 110 to 150 $g/m^2$. The explosion strength of the liner is preferably not less than 3.0, more preferably not less than 4.0, and most preferably not less than 5.0, depending on the site on which the corrugated board sheet is used. The compression strength of the liner is preferably not less than 10 kgf, more preferably not less than 15 kgf and most preferably not less than 20 kgf.

As the corrugated medium of the corrugated board sheet, the corrugated medium of class A, class B or class C according to JIS P 3904, may be used. Any conventional corrugated medium such as specially prepared high ring rush corrugated medium, water-proofed corrugated medium, or a class D corrugated medium may be used. The basis weight of the corrugated medium is preferably not less than 100 $g/m^2$, more preferably 100 to 200 $g/m^2$, particularly preferably 110 to 170 $g/m^2$ and most preferably 110 to 150 $g/m^2$. The corrugated medium has a thickness preferably not more than 0.5 mm, more preferably not more than 0.4 mm and most preferably not more than 0.3 mm. The compression strength of the corrugated medium is preferably not less than 8 kgf·m$^3$/g, more preferably not less than 10 kgf·m$^3$/g, and most preferably not less than 12 kgf·m$^3$/g.

The liner and the corrugated medium are preferably formed of the same material. The starting material for the liner and the corrugated medium of the corrugated board sheet may be bleached paper or newspaper sheets not de-inked and may be mixed or may not be mixed with natural pulp formed of wood pulp such as that prepared from needle-leaved trees, broad-leaved trees or both the needle-leaved trees and broad-leaved trees. The starting materials may be bleached or non-bleached and may be prepared by a craft method or a sulfite method. Plural layers of these materials may be laminated together. The liner or the corrugated medium may also contain various additives, including dry paper power intensifiers, such as cationated starch, cationated polyacrylamide, anionated polyacrylamide or gelatine, wet paper power intensifiers, such as melamine resin, urea resin or epoxy polyamide resins, sizing agents, such as fatty acid salts, rodin derivatives, emulsified dialkyl ketene dimers, petroleum resin emulsions or ammonium salts of styrene- maleic anhydride copolymer alkylesters, pigments, such as clay, kaolin, calcium carbonate, barium sulfate or titanium oxide, polyvalent metal salts, such as aluminum sulfate or aluminum chloride, cation-modified polymers, such as cationated starch or pH controllers, such as caustic soda, sodium carbonate or hydrochloric acid.

Any conventionally used adhesives of corrugated board sheets may be used. Corn starch adhesives for the corrugated board sheets, composed of a carrier liquid prepared by expanding and destructing the starch along with sodium hydroxide in heated water, and a main liquid prepared by dispersing starch along with borax in water maintained at lower temperature, and exhibiting lower viscosity and high starch concentration, are desirable. The corrugated board sheet, thus prepared, has an explosion strength preferably not less than 6.0 kgf/cm$^2$, more preferably not less than 8.0 kgf/cm$^2$ and most preferably not less than 10 kgf/cm$^2$. The corrugated board sheet may also be perforated for assuring transmittance to moisture.

The pored film in the moisture-transmitting packaging material with a paper material and a pored film may be constructed in any desired manner as to the composition, layered structure or thickness, provided that it exhibits pores or small-sized pores and exhibits transmittance to moisture. The moisture-transmitting light-shielding film may be formed of one or more of resins, such as homopolyethylene resin, homopolypropylene resin, propylene-α olefin copolymer resin, ethylene copolymer resin, polyacetal resin, polyamide resin, polyester resins, such as polyethylene terephthalate resin or polyethylene naphthalate resin, polyethylene tetrafluoride resin, polyvinyl alcohol resin or isotactic polystyrene resin. The polyethylene resin and polypropylene resin are preferred, while low-density homopolyethylene resins (LDPE), high-density homopolyethylene resins (HDPE), linear low-density polyethylene resins (L-LDPE), homopolypropylene resins and propylene ethylene copolymer resins are particularly preferred. Typical of the ethylene copolymer resins are as follows:

(1) ethylene-vinyl acetate copolymer resins (EVA);
(2) ethylene-propylene copolymer resin
(3) ethylene-1-butene copolymer resin
(4) ethylene-butadiene copolymer resin
(5) ethylene-vinyl chloride copolymer resin
(6) ethylene-methyl methacrylate copolymer resin (EMM resin)
(7) ethylene-methyl acrylate copolymer resin (EMA resin)
(8) ethylene-ethyl acrylate copolymer resin (EEA resin)
(9) ethylene-acrylonitrile copolymer resin
(10) ethylene-acrylic acid copolymer resin (EAA resin)
(11) ionomer resin (resin comprised of an ethylene-unsaturated acid copolymer cross-linked with metal, such as zinc)
(12) ethylene-α olefin resin (L-LDPE resin)
(13) ethylene-propylene-butene-1 ternary copolymer resin
(14) ethylene-propylene elastomer The above-mentioned L-LDPE resin is a copolymer obtained on copolymerizing ethylene and a olefin having 3 to 13 and preferably 4 to 10 carbon atoms by a low-pressure method or an improved high-pressure method and is a polyethylene resin having short branches in a straight chain. Among α-olefins preferred in physical strength and costs, there are butene-1, octene-1, hexene-1, 4-methyl pentene-1, heptene-1 and decene-1. Among the methods for polymerizing the L-LDPE resins, there are a gas phase method employing a mid to low pressure device, a solution method, a liquid slurry method and an ion polymerization method employing an improved high-pressure method. Examples of the marketed L-LDPE resins include G resin and NUC-FLX (UCC Corporation), Dowlex (Dow-Chemical Inc.), Sclair (Du-Pont Canada), Malex (Phillips Inc.), Stamilex (DSM Inc.), Excellene VL (SUMITOMO CHEMICALS), Neozex (MITSUI PETROCHEMICALS), Mitsubishi polyethylene-LL (MITSUBISHI YUKA), Nisseki Linilex (NIPPON SEKIYU-KAGAKU), NUC Polyethylene- LL (Nippon Unicar) and Idemitsu Polyethylene L (IDEMITSU SEKIYU-KAGAKU), as ethylene butene-1 copolymer resins; TUFLIN (UCC) and TUFTHENE (NIPPON UNICAR), as ethylene.hexene-1 copolymer; Ultozex (MITSUI SEKIYU-KAGAKU), as ethylene.4 methylpentene-1 copolymer resin; and Stamilex (DSC), Dowles (Dow Chemicals), Sclair (DuPont CANADA) and MORETEC (IDEMITSU SEKIYU-KAGAKU), as ethylene octene-1 copolymer resins.

Of the L-LDPE resins, those preferred as film molded products in physical strength, heat-sealing strength and film moldability are those with a melt flow rate (MFR) at 190° C. and under a load of 2.16 kgf according to JIS K-6760 of 0.8 to 10 g/10 minutes, preferably 1.0 to 7 g/10 minutes, a density according to JIS K-6760 of 0.870 to 0.940 g/cm$^3$ and preferably 0.890 to 0.930 g/cm$^3$ and the number of carbon atoms of α-olefin of 6 to 8, produced by a liquid slurry method and a gas phase method. If the L-LDPE resin is produced by injection molding, such resin with the MFR of 2 to 80 g/10 minutes, and preferably 5 to 50 g/10 minutes, a density of 0.890 to 0.980 g/cm$^3$ and preferably 0.900 to 0.970 g/cm$^3$ and the number of carbon atoms of α-olefin of 3 to 8, obtained by the liquid phase slurry method and a gas phase method, is desirable in improved physical strength and in balanced injection moldability. Preferred examples of the film molded products include Ultzex (MITSUI SEKIYU-KAGAKU), Moretac (IDEMITSU PETROCHEMICALS), STAMILEX (dsm), DOWWLEX (DOW CHEMICALS), TUFLIN (UCC) and TUFTHENE (NIPPON UNICAR). Ultra-low-density linear LDPE resin, having a density of less than 0.910 g/cm$^3$, such as NUC-FLX (UCC) or EXCELLENE (SUMITOMO CHEMICALS), may also be used.

Preferably, lubricants are added to the above resins for improving lubricity and fluidity of the resins. The amount of addition of the lubricants depends on the lubricant type. Thus, in the case of a lubricant with only low lubricant effects aimed at maintaining photographic performance of the silver halide photosensitive material, such as fatty acid metal salts, the amount of addition of the lubricant is preferably 0.03 to 5 wt %, more preferably 0.05 to 3 wt % and most preferably 0.1 to 1.5 wt %. In the case of fatty acid amide based lubricant and bis fatty acid amide based lubricant exhibiting high lubricant effects and adversely affecting the silver halide photosensitive material, the amount of addition is preferably 0.01 to 1 wt %, more preferably 0.03 to 0.5 wt % and most preferably 0.05 to 0.3 wt %. Preferred examples of the lubricants include:

(1) fatty acid amide based lubricants:

a. saturated fatty acid amide based lubricants:

(i) Behenic acid amide based lubricants: Diamid KN (NIPPON KASEI);

(ii) stearic acid amide based lubricants: Armide HT (LION YUSHI), Alflow-S-10 (NIPPON YUSHI); Fatty Acid Amide S (KAO), Diamid 200 (NIPPON KASEI), Diamid AP-1 (NIPPON KASEI), Amide S.Amide T (NITTOH KAGAKU), and Neutron (NIPPON SEIKO).

b. Hydroxy stearic acid amide based lubricants:

(i) Palmitic acid amide based lubricants: Neutron S-18 (NIPPON SEIKA) and Amide P (NITTOH KAGAKU)

(ii) Lauric acid amide based lubricants: Armide C (LION ACZO) and Diamid (NIPPON KASEI).

c. Unsaturated fatty acid amide based lubricants:

(i) Erucic acid amide based lubricants: Alflow P-10 (NIPPON YUSHI), Neutron-S (NIPPON SEIKA), LUBROL(I.C.I), Diamid L-200 (NIPPON KASEI).

(ii) Oleic acid amide based lubricants: Armoslip CP (LION ACZO), Neutron (NIPPON SEIKA), Amide O (NITTOH KAGAKU), Diamid O-200 AND DIAMID G-200 (NIPPON KASEI), Alflow-E-10 (NIPPON YUSHI) and fatty acid amide O (KAO CO.).

d. Bis fatty acid amide based lubricants:

(i) methylenebis behenic acid amide based lubricants: Diamid NK bis (NIPPON KASEI)

(ii) methylenebis stearic acid amide based lubricants: Diamid 200 bis (NIPPON KASEI)

(iii) methylenebis oleic acid amide based lubricants: lubron 0 (NIPPON KASEI)

(iv) ethylene bis stearic acid amide based lubricants: Armoslip EBS (LION ACZO)

(v) hexamethylene bis stearic acid amide based lubricants: Amide 65 (KAWAKEN FINE CHEMICALS)

(vi) hexamethylene bis oleic acid amide based lubricants: Amide 60 (KAWAKEN FINE CHEMICALS)

(2) Non-ionic surfactant-based lubricants: Electrostripper TS-2, Electrostripper TS-3 (KAO CO.)

(3) Hydrocarbon-based lubricants: Fluid paraffin, natural paraffin, micro-wax, synthetic paraffin, polyethylene wax (with an average molecular weight of not larger than 10,000, preferably not more than 8,000 and more preferably not more than 6,000), polypropylene wax (with average molecular weight of not more than 10,000, preferably not more than 8,000 and more preferably not more than 6,000), chlorinated hydrocarbon and fluorocarbon.

(4) Fatty acid based lubricants: higher fatty acids, such as caproic acid, stearic acid, oleic acid, erucic acid or palmitic acid (preferably with the number of carbon atoms of not less than 12), and oxy fatty acids.

(5) Ester-based lubricants: lower alcohol esters of fatty acids, polyhydric alcohol esters of fatty acids, polyglycol esters of fatty acids and aliphatic alcohol esters of fatty acids.

(6) Alcoholic lubricants: polyhydric alcohols, polyglycol and polyglycerol.

(7) Metal soaps: compounds of higher fatty acids, such as lauric acid, stearic acid, succinic acid, stearyl lactic acid, lactic acid, phthalic acid, benzoic acid, hydroxy stearic acid, ricinoleic acid, naphthenic acid, oleic acid, palmitic acid or erucic acid with metals, such as Li, Na, Mg, Ca, Sr, Ba, Zn, Cd, Al, Sn, Pb or Cd, preferably magnesium stearate, calcium stearate, zinc stearate and magnesium oleate.

(8) Partial saponified product of montanic acid esters (9) Silicone based lubricants: dimethyl polysiloxane of various grades and modified products thereof (SHIN-ETSU SILICONE and TORAY SILICONE); especially various silicone oils are preferred.

To the above resins, anti-static agents are preferably added in order to render conductive and disperse static charges generated due to friction. Among the anti-static agents, non-ionic anti-static agents are particularly preferred for avoiding adverse effects on photographic performance or human health and for preventing static marks. The amount of addition of the anti-static agents is preferably 0.01 to 5 parts by weight, more preferably 0.05 to 3 parts by weight and most preferably 0.1 to 1.5 part by weight to 100 parts by weight of resin. Examples of the illustrative anti-static gents include:

(1) non-ionic agents a. alkylamine derivatives: T-B103 (MATSUMOTO YUSHI) and T-B104 (MATSUMOTO YUSHI)

(i) polyoxyethylene alkylamine: Armostat 410 (LION CO.);

(ii) tertiary amines (laurylamine): Armostat 400 (LION CO.);

(iii) N, N-bis (2-hydroxylethyl cocoamine): Armostat 410 (LION CO.)

(iv) tertiary amines: ANTISTATIC 273C, 273, 273E (FINE ORG. CHEM)

(v) N-hydroxyhexadecyl-di-ethanol-amine: Belg. P. 654, 049;

(vi) N-hydroxyoctadecyl-di-ethanol-amine: (NATIONAL DIST.)

b. fatty acid amide derivatives TN-115 (MATSUMOTO YUSHI), Elegan P100 (NIPPON YUSHI), Erik SM-2 (YOSHIMURA YUKAGAKU);

(i) hydroxy stearic acid amide (ii) succinic acid-N, N- distearylamide butyl ester (HOECHIST)

(iii) polyoxyethylene alkylamide c. ether type (i) polyoxyethylene alkylether (ii) $RO(CH_2CH_2)_nH$ (iii) polyoxyethylene alkylphenylether (iv) special non-ionic type: Resistat 104, PE100, 116 to 118 (DAI-ICHI KOGYO SEIYAKU), Resistat PE132, 139 (DAI-ICHI KOGYO SEIYAKU), Elegan E115, Chemistat 1005 (NIPPON YUSHI), Erik BM-1 (YOSHIMURA YUKAGAKU), Electrostripper TS, TS2, 3, 5, EA2, EA3 (KAO CO.).

d. polyhydric alcohol ester type (i) glycerin fatty acid ester: mono-, di- or tri-glyceride of stearic acid or hydroxystearic acid, Monogly (NIPON SHONO), TB123 (MATSUMOTO YUSHI), Resistat 113 (DAI-ICHI KOGYO SEIYAKU)

(ii) sorbitan fatty acid ester (iii) special ester: Eric BS-1 (YOSHIMURA KAGAKU)

(iv) 1-hydroxyethyl-2-dodecylglyoxazoline: BRITISH CELLOPHANE (2) anionic a. sulfonic acids: alkyl sulfonates, $RSO_3Na$, alkylbenzene sulfonates, alkyl sulfates, $ROSO_3Na$ b. phosphoric acid ester type: alkyl phosphates (3) cationic a. amide type cations: Resistat PE300, 401, 402, 406, 411 (DAI-ICHI-KOGYO SEIYAKU)

b. quaternary ammonium salts: Catimine CSM-9 (YOSHIMURA YUKAGAKU), CATANAC 609 (AMERICAN CYANAMID), Denon 314C (MARUBISHI YUKA), Armostat 300 (LION YUSHI), 10V (ARMOR), Electrostripper ES (KAO CO.), Chemistat 2009A (NIPPON YUSHI), CATANAC.SN (AMERICA CYANAMIDE). amphoteric ion type a. alkyl betaine type b. imidazoline type: Rheostat 53, 532 (LION CO.), AMS53 (LION CO.), AMS 303, 313 (LION CO.)

c. alkylimidazoline type (i) metal salt type: AMS576 (LION CO.); Rheostat 826, 923 (LION CO.), $(RNR'CH_2CH_2CH_2NCH_2COO)_2Mg$ (R≧C, R7-H or $(CH_2)mCOO$—) (LION CO.)

(ii) alkyl alanine type (5) electrically conductive lipids: polyvinyl benzyl type cation, polyacrylic acid type cations (6) others: Resistat 204, 205 (DAI-ICHI KOGYO SEIYAKU), Elegan 2E, 100E (NIPPON YUSHI), Chemistat 1002, 1003, 2020 (NIPPON YUSHI), Erik 51 (YOSHIMURA YUKAGAKU), ALROMINE RV-100 (GEIGY).

For preventing oxidative decomposition of hydrocarbonic resins, anti-oxidation agents are preferably added to the resins. The anti-oxidation agents include a free radical concatenation inhibiting agent and a peroxide decomposition agent. The peroxide decomposition agent may be classed into a sulfur based decomposition agent and a phosphorus-based decomposition agent for preventing discoloration to yellow or brownish color by thermal degradation of the thermoplastic resins or generation of (blackish agglomeration of foreign substances), it is preferred to use both the free radical concatenation inhibiting agent and the peroxide decomposition agent. For preventing thermal degradation of the resins, organic cyclic phosphoric acid compounds may be added in an arbitrary amount of preferably 0.001 to 1 wt %, more preferably 0.005 to 0.8 wt % and most preferably 0.01 to 0.5 wt %. Moreover, radical arresting agents may be added. The amounts of a variety of anti-oxidants, which are simultaneously reducing agents acting unfavorably on silver halide photosensitive materials, are strictly controlled and preferably 0.0005 to 2.0 parts by weight, more preferably 0.001 to 1.0 part by weight and most preferably 0.005 to 0.45 part by weight. The amount of addition of the anti-oxidants based on the total weight of the entire moisture-transmitting light-shielding film is preferably 0.0008 to 0.8 wt % and more preferably 0.0015 to 0.4 wt %. Illustrative examples of the anti-oxidants include:

(1) Phenolic anti-oxidants: 6-t-butyl-3-methyl phenyl derivatives, 2.6-di-t-butyl-P-cresol, 2.6-t-butyl-4-ethyl phenol; 2.2'-methylenebis-(4-ethyl-t-butyl phenol), 4.4'-butylidene bis (6-t-butyl-m-cresol), 4.4'-thiobis (6-t-butyl-m-cresol), 4.4'-dihydroxy diphenyl cyclohexane, alkylated bisphenol, styrenated phenol, 2.6-d-t-butyl-4-methyl phenol, n-octadecyl-3-(3'.5'-di-t-butyl-4'-hydroxy phenyl) propionate, 2.2'-methylenebis(4-methyl-6-t-butyl phenol), 4,4'-thiobis(3-methyl-6-t-butyl phenyl), 4.4'-butylidenebis (3-methyl-6-butyl phenol), stearyl-β(3.5-di-4-butyl-4-hydroxy phenyl) propionate, 1.1.3-tris (2-methyl-4-hydroxy-5-t-butyl phenyl) butane, 1.3.5-trimethyl-2.4.6-tris (3.5-di-t-butyl-4-hydroxy benzyl) benzene, tetrakis[methylene-3(3'.5'-di-t-butyl-4-hydroxy phenyl) propionate] methane.

(2) ketone amine condensate based anti-oxidant: 6-ethoxy-2.2.4-trimethyl-1.2-dihydroxy quinoline, 2.2.4- trimethyl-1.2-dihydroquinoline polymers and trimethyl dihydroquinoline derivatives.

(3) allylamine based anti-oxidants: phenyl-α-naphthylamine, N-phenyl-β-naphthylamine, N-phenyl-N'-isopropyl-P-phenylenediamine, N.N'-diphenyl-P-phenylene diamine, N.N'-di-β-naphthyl-P-phenylenediamine and N-(3'- hydroxy butylidene)-1-naphthylamine.

(4) imidalolic anti-oxidants: zinc salts of 2-mercapto benzimidazole and 2-mercapto benzimidazole and 2- mercapto methyl benzoimidazole.

(5) phosphite based anti-oxidants: alkylated allyl phosphite, tris(mono- or di- nonyl phenyl) phosphite, cyclic neopentane tetrayl bis (2.6-di-t-butyl-4-methylphenyl) phosphite, diphenyl isodecyl phosphite, tris(nonyl phenyl) phosphite sodium phosphite, tris (nonyl phenyl) phosphite, 2.2-methylenebis (4.6-di-t-butyl phenyl) octyl phosphite, tris (2.4-di-t-butyl phenyl) phosphite and triphenyl phosphite.

(6) thiourea based anti-oxidants: thiourea derivatives, 1.3-bis(dimethyl aminopropyl)-2-thiourea.

(7) other anti-oxidants effective against atmospheric oxidation: dilauryl thio dipropionate.

Illustrative examples of marketed anti-oxidants include:

(1) phenolic anti-oxidants: SUMILIZER BHT (SUMITOMO), IRGANOX 1076 (CIBA-GEIGY), MARK AO-50 (ADECA-ARGUS), SUMILIZER BP-76 (SUMITOMO), TOMINOX SS (YOSHITOMI), IRGANOX 565 (CIBA-GEIGY), IONOX WSP (ICI), SANTONOX (MONSANTO), SUMILIZER WX R (SUMITOMO), ANTAGECRYSTAL (KAWAGUCHI), IRGANOX 1035 (CIBA-GEIGY), ANTAGE W-400 (KAWAGUCHI), NOCLIZER NS-6 (OUCHI-SHINKO), IRGANOX 1425 WL (CIBA-GEIGY), MARK AO-80 (ADECA ARGUS), SUMILIZER GA-80 (SUMITOMO), TOPANOL CA(ICI), MARK AO-30 (ADECA ARGUS), MARK AO-20 (ADECA ARGUS), IRGANOX 3114 (CIBA-GEIGY), MARK AO-330 (ADECA ARGUS), IRGANOX 1330 (CIBA-GEIGY), CYANOX 1790 (ACC), IRGANOX 1010 (CIBA-GEIGY), MARK AO-60 (ADECA ARGUS), SUMILIZER BP-101 (SUMITOMO) and TO-MINOX TT (YOSHITOMI).

(2) phosphorus-based anti-oxidants: IRGAFOS 168 (CIBA-GEIGY), MARK 2112 (ADECA ARGUS), WESTON 618 (BORG WARNER), MARK PEP-8 (ADECA ARGUS), ULTRANOX 626 (BORG WARNER))), MARK PEP-24G (ADECA ARGUS), MARK PEP-36 (ADECA ARGUS) and HCA (SANKO).

(3) thioether-based anti-oxidants: DLTDP "YOSHITOMI" (YOSHITOMI), SUMILIZER TPL (SUMITOMO), ANTIOX L (NICHI-YU), DMTD "YOSHITOMI" (YOSHITOMI), SUMILIZER TPM (SUMITOMO), ANTIOX M (NICHI-YU), DSTP "YOSHITOMI" (YOSHITOMI), SUMILIZER TPS (SUMITOMO), ANTIOX S (NICHI-YU), SEENOX 412S (SIPRO), MARK AO-412 S (ADECA ARGUS), SUMILIZER TP-D (SUMITOMO), MARK AO-23 (ADECA ARGUS), SANDSTAB P-EPQ (SAND), IRGAFOS P-EPQ FF (CIBA-GEIGY), IRGANOX 1222 (CIBA-GEIGY), MARK 329K (ADECA ARGUS), WESTON399 (BORG WARNER), MARK 260 (ADECA ARGUS) and MARK 522A (ADECA ARGUS).

(4) metal inactivators: NAUGARD XL-1 (UNI-ROYAL), MARK CDA-1 (ADECA ARGUS), MARK CDA-6 (ADECA ARGUS), LAGANOX-1024 (CIBA-GEIGY) and CUNOX (MITSUI-TOATSU).

Most desirable anti-oxidants include phenolic anti-oxidants. Examples of the marketed anti-oxidants include various goods of the Irganox series by CIBA-GEIGY, BHT, Sumilizer BH-76, Sumilizer WX-R and Sumilizer BP-101 by SUMITOMO KAGAKU KK. Two or more of 2,6-di-bibutyl-p-cresol (BHT), high-molecular phenolic anti-oxidants of low volatility (trade names: Irganox 1010, Irganox 1076, Topanol CA and Ionox 330), diurylthio dipropionate, distearyl thiopropionate and dialkyl phosphate, mixed together, are desirable in raising the anti-oxidant effect. The anti-oxidant most desirable for the present invention is hindered phenolic anti-oxidant. The following are typical examples of the hindered phenolic anti-oxidant.

1,3,5-trimethyl 2,4,6-tris(3,5-di- tert-butyl-4-hydroxy benzyl) benzene, tetrakis [methylene-3-(3'-5'-di-tert-butyl-4'-hydroxy phenyl)propionate] methane, octadecyl-3,5-di-tert-butyl-4-hydroxy-hydrocinnamate), 2,2',2'-tris[(3,5-di-tert-butyl-4-hydroxy phenyl)propionyloxy] ethyl isocyanurate, 1,3,5-tris-(4-tert-butyl-3-hydroxy-2,6-di-methylbenzyl] isocyanurate, tetrakis(2,4- di-tert-butylphenyl) 4,4'-biphenylene diphosphite ester, 4,4'-thiobis-(6-tert-butyl-O-cresol), 2,2'-thiobis-(6-tert-butyl-4-methylphenol), tris-(2-methyl-4-hydroxy-5-tert-butylphenyl) butane, 2,2'-methylene-bis-(4-methyl-6-tert-butylphenol),4,4'-methylene-bis-(2,6-di-tert-butylphenol), 4,4'-butylidenebis-(3-methyl-6-tert-butylphenol), 2,6-di-tert-butyl-4-methylphenol,4-hydroxymethyl-2,6-di-tert-butylphenol, 2,6-di-tert-4-n-butylphenol, 2,6-bis(2'-hydroxy-3'-tert-butyl-5'-methylbenzyl)-4-methylphenol, 4,4'-methylene-bis-(6-tert-butyl-O-cresol), 4,4'-butylidene-bis(6-tert-butyl-m-cresol), 3.9-bis{1.1-dimethyl-2-[β-3-t-butyl-4-hydroxy-5-methylphenyl) propionyloxy]ethyl}2, 4.8,10-tetraoxaspiro[5,5] undecane. Of these, those melting at a temperature not less than 100° C., in particular at an optional temperature of not less than 120° C., are preferred. The anti-oxidants are used in combination with phosphorus-based anti-oxidants for utmost effects.

The above-mentioned resin composition may be added to with light-shielding materials for assuring light-shielding properties. In this case, the light-shielding materials are added in an amount of preferably 0.1 to 48 wt %, more preferably 0.3 to 30 wt %, particularly preferably 0.5 to 20 wt % and most preferably 1.0 to 7.0 wt %, based on the weight of the resin composition. The following are representative examples of the light-shielding materials.

(1) Inorganic Compounds (i) oxides: silica, diatomaceous earth, alumina, titanium oxide, iron oxide, zinc oxide, magnesium oxide, antimony oxide, barium ferrite, strontium ferrite, beryllium oxide, pumice, pumice balloon and alumina fibers.

(ii) hydroxides: aluminum hydroxide, magnesium hydroxide and basic magnesium carbonate.

(iii) carbonates: calcium carbonate, magnesium carbonate, dolomite and dorsonite.

(iv) phosphates (phosphates): calcium sulfate, barium sulfate, ammonium sulfate and calcium phosphite.

(v) silicates: talc, clay, mica, asbestos, glass fibers, glass balloons, glass beads, calcium silicate, montmorillonite and bentonite.

(vi) carbon: carbon black, graphite, carbon fibers and hollow carbon balls.

(vii) others: iron powders, copper powders, lead powders, tin powders, stainless steel powders, pearl pigments, aluminum powders, molybdenum sulfide, boron fibers, silicon carbide fibers, brass fibers, potassium titanate, titanium oxide lead zirconate, zinc borate, barium metaborate, calcium borate, sodium borate, aluminum paste and talc.

(2) Organic Compounds: wood powders (powders of pine or oak or sawdust), fibers of husks (almond, peanuts and rice husks), various colored fibers, such as cotton, jute, paper pieces, cellophane pieces, nylon fibers, polypropylene fibers, starch and aromatic polyamide fibers.

Of these light-shielding materials, carbon black is preferred in reducing bleed-out amounts of the lubricants or anti-oxidants. According to classification of carbon black by starting materials, most preferred are gas black, furnace black, channel black, thermal black, anthracene black, acetylene black, ketches carbon black, thermal black, lamp black, oil fume, pine fume, animal black and vegetable black. More preferred is furnace carbon black in view of light-shielding properties, cost and physical properties. On the other hand, more preferred are acetylene carbon black and ketches carbon black, which is modified by-produced carbo black, in view of anti-static effect and improved light-shielding properties, despite high cost. The above may be used as an admixture.

As for carbon black, that with pH of 6.0 to 9.0 and an average particle size of 10 to 120 nm is preferred since it is free from fogging with respect to the silver halide photosensitive material, suffers from increased or decreased photosensitivity and exhibits high light-shielding properties when the carbon black is used as a light-shielding material, and also since such carbon black is less susceptible to agglomeration or pinholes due to fish-eyes when added to the resin composition of the film as a packaging material for the packaged silver halide photosensitive material according to the present invention. In particular, furnace carbon black having volatile contents of not more than 2.0% and oil absorbency of not less than 50 ml/100 g is preferred.

Preferred marketed articles of carbon black include carbon black #20(B), #30(B), #33(B), #40(B), #44(B), #45(B), #50(B), #55(B), #100(B), #600(B), #2200(B), #2400(B), MA8, MA11 and MA100 produced by Mitsubishi Chemical Co.. Overseas articles include, for example, Black Pearls 2, 46, 70, 71, 74, 80, 81 and 607, Regal 300, 330, 400, 660 and 991, SRF-S, Vulcan 3, 6 and Sterling 10, SO, V, S, FT-FF and MT-FF, produced by CABBOT. Other examples include United R, BB, 15, 102, 3001, 3004, 3006, 3007, 3008, 3009, 3011, 3012, XC-3016, XC-3017 and 3020, produced by Ashland Chemical.

Among a variety of methods for mixing the light-shielding materials to the resin, a master batch method is preferred in cost, and in view of prevention of pollution on the working site. There are a method of dispersing carbon black in a solution of a polymer in an organic solvent for preparing a polymer-carbon black master batch, as disclosed in JP Patent Kokoku JP-B-40-26196, and a method of dispersing carbon black in polyethylene to prepare a master batch, as is disclosed in JP Patent Kokoku JP-B-43-10362.

In addition to the above-mentioned lubricants, anti-static agents, anti-oxidants and light-shielding materials, organic cyclic phosphoric acid compounds, radical seizing agents, UV absorbers, organic nucleating agents, drip-proofing agents, compatibilizers, aromatic agents or hygroscopic resins may be added to the resin.

If a perforated film is used as a pored film in the moisture-transmitting packaging material with a paper material and a pored film, perforations are preferably formed uniformly in the film for achieving uniform moisture in the packaged roll-shaped silver halide photosensitive material. For satisfying the demand for transmittance to moisture, the perforations are preferably 1.0 to 35 mm, more preferably 1.0 to 30 mm, particularly preferably 5 to 25 mm and most preferably 10 to 20 mm. If the lateral sides of the packaged roll-shaped silver halide photosensitive material should be rendered permeative to moisture, perforations are preferably formed uniformly on circumferences of plural circles of pre-set values of radius centered on the winding core. The radial spacing between neighboring circumferences is preferably 30 to 150 mm, more preferably 35 to 100 mm and most preferably 40 to 60 mm. The smallest spacing between neighboring perforations on the same circumference of the circle is preferably 30 to 150 mm, more preferably 35 to 100 mm and most preferably 40 to 60 mm. If perforations are not formed circumferentially, it is preferred to form perforations in a uniform lattice shape. Specifically, parallel vertical lines of equal spacing and parallel transverse lines of equal spacing inclined at a pre-set angle relative to the vertical lines are drawn on a film and perforations are formed at the points of intersections of the vertical and transverse lines. The distance between the perforations closest to each other is preferably 30 to 200 mm, more preferably 35 to 150 mm, particularly preferably 40 to 100 mm and most preferably 40 to 60 mm. As a paper material used in the combination with the perforated film, a corrugated board sheet is preferably laminated for assuring complete light-shielding properties and for assuring transmittance to moisture. If a fine-pore film is used as a pored film, they may have a nature for a ream of gas permeability pore enough for securing the transmittance to moisture, and may have pre-set diameter and ratio of the gas permeability pore, and the diameter of fine pores of the film is preferably 0.01 to 50 pm, more preferably 0.05 to 20 $\mu$m, particularly preferably 0.05 to 20 $\mu$m and most preferably 0.1 to 10 $\mu$m.

The above described pored film is preferably air-permeative. The Galet air transmittance according to JIS P8117 is preferably 0.01 to 10000 seconds/100 ml, more preferably 0.1 to 5000 seconds/ 100 ml, particularly preferably 1 to 2500 seconds/ 100 ml and most preferably 5 to 1000 seconds/100 ml.

Now, as a pore-area ratio of the perforated film, the ratio of the pore-area in the layer of the surface side is regarded as an effective ratio of the pore-area in case that the perforated film is arranged in the duplication. And, regarding a denominator in which a ratio of the pore-area is counted, the area of the surface in the perforated side becomes a denominator. Namely, in case that the perforated film is arranged in the one lateral side, the area of the surface in the said one lateral side becomes a denominator. In case that the perforated film is arranged in the both two lateral sides, the area of the surface in the said both two lateral sides becomes a denominator, and in case that the perforated film is arranged in the periphery, the area of the surface in the periphery becomes a denominator. The pore-area ratio of the perforated film is 20 to 80% of the film.

When the moisture-permeative film is wound about the outer periphery of the roll-shaped silver halide photosensitive material, a film having fine pores without having perforations and exhibiting transmittance to moisture is preferred. If pre-set transmittance properties to moisture is met as a whole, the paper material and the pored film may be wound once to form a sole layer or wound a number of times to form multiple layers. The film may be varied suitably in thickness depending on the number of turns and on the overall transmittance to moisture. If the film is wound once to three times, the film thickness is preferably 20 to 130 $\mu$m, more preferably 30 to 100 $\mu$m and most preferably 40 to 80 $\mu$m. The film may be secured to the winding core, if so desired, by any means, such as by a cord, an O-ring, an adhesive tape or an adhesive. When the film is secured to the winding core, the pored film is preferably colored black to obtain the light-shielding property of the part of the winding core.

In addition to the above, non-woven fabrics may be used together therewith. In such a case the non-woven fabrics may be wet type non-woven fabric, produced by a method similar to the paper making method, or a dry type non-woven fabric, such as a card type, air-lay type, resin bond type, thermal bond type, span bond type, stitch bond type, needle punch type melt blow type or a span lace type. The non-woven fabric may be formed of any known materials, including organic fibers, such as polyester, nylon, rayon, vinylon, polypropylene, polyethylene, polyvinyl chloride, polyvinylidene chloride, acryl, polyurethane, ethylene-vinyl acetate, saran or ionomer, inorganic fibers or natural fibers, such as cotton or pulp. As for the production method, any known methods, such as ultrasonic fusion method, pulltrusion molding and so forth, may be used.

The film exhibiting transmittance to moisture may be used on a peripheral surface or on the laterals sides of the roll-shaped silver halide photosensitive material of the packaged roll-shaped silver halide photosensitive material according to the present invention. If the film is used for the peripheral surface, it is preferred that a film having fine pores without having the perforations and exhibiting transmittance to moisture be wound once or at least twice on the peripheral surface of the roll-shaped silver halide photosensitive material. It is also possible to laminate plural moisture-permeative films of different materials. If the film is used for lateral sides, perforated films may be used in addition to the films having the fine pores. In this case, the film is preferably employed in combination with corrugated board sheets or non-woven fabrics. It is also possible to lay only the corrugated board sheets or non-woven fabrics on the lateral sides. If the packaged roll-shaped silver halide photosensitive material in its entirety exhibits transmittance to moisture, the films, sheets or cloths may be applied in plural layers. For example, two layers of a corrugated board sheet and a perforated film, two layers of a corrugated board sheet and a non-woven fabric, three layers of a corrugated board sheet, a fine pore film and a non-woven fabric and four layers of a corrugated board sheet, a perforated film, a corrugated board sheet and a perforated film, may be applied, looking from the side of the photosensitive material.

In such way, according to the present invention, the packaging material comprising a combination of a paper material with a pored film may further contain non-woven fabrics, woven fabrics, knitted material, and others, in the extent not to affect the transmittance to moisture in need for the present invention.

The transmittance to moisture according to JIS Z-0208 at a temperature of 40° C. and a relative humidity of 90% of a packaging material for the packaged roll-shaped silver halide photosensitive material is preferably not less than 5.1 $g/m^2 \cdot 24$ hours, more preferably not less than 7.0 $g/m^2 \cdot 24$ hours, particularly preferably not less than 10.1 $g/m^2 \cdot 24$ hours and most preferably not less than 15.1 $g/m^2$ 24 hours.

The winding core, about which a silver halide photosensitive material is wound in a roll shape, may be any known type of the winding core. In view of strength, moisture-proofness, extendibility, surface shape, lubricity relative to the innermost surface of the photosensitive material, degree of thrusting of the photosensitive material by a cushioning material, degree of absorption of the thrusting by the cushioning material, cost and the effect on the photosensitive material, the winding core may be formed of virgin pulp, natural paper or synthetic paper, such as wasted paper regenerated paper, plastics, laminated or not laminated with moisture-proofing films, metal foils or vaporized metal films, or laminated further with an expanded polyurethane, expanded polyethylene sheet or expanded polyethylene paper for producing the cushioning effect.

For the silver halide photosensitive material, all materials that can be wound on the winding core may be used. However, for use effectively with a roll-shaped silver halide photosensitive material of particularly large size and weight, for assuring workability and ecomomicity and for preventing degradation with lapse of time, the winding diameter, that is diameter of the silver halide photosensitive material as wound on the winding core, is not less than 30 cm, preferably not less than 40 cm, more preferably 50 to 120 cm and most preferably 60 to 100 cm. The winding length of the roll-shaped silver halide photosensitive material is not less than 500 m, preferably not less than 1000 m, particularly preferably 1500 to 3000 m and most preferably 2000 to 3000 m. In the silver halide photosensitive material, such material containing silver chloride, more specifically, a silver halide photosensitive material containing preferably not less than 25 mol %, more preferably not less than 50 mol %, particularly preferably not less than 80 mol% and most preferably not less than 97 mol % of silver chloride, has a particular effect proper to the present invention.

EXPLANATION OF NUMERALS

Figure 1:
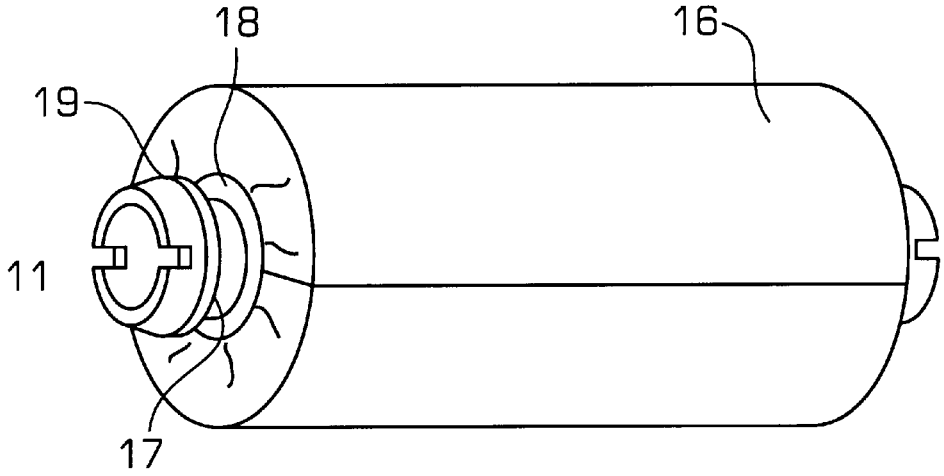
FIG. 1 is a schematic perspective view showing an example of a first embodiment according to the present invention.

1, . . . protective coating layer;
2, . . . red-sensitive layer;
3, . . . intermediate layer;
4, . . . green-sensitive layer;
5, . . . intermediate layer;
6, . . . blue-sensitive layer;
7, . . . polyethylene layer;
8, . . . paper layer;
9, . . . polyethylene layer;
11, . . . winding core;
12, . . . roll-shaped silver halide photosensitive material;
13, . . . protective board ("ate boru");
14, . . . adhesive tape;
15, . . . adhesive tape;
16, . . . fine-pore film;
17, . . . both lateral side ends;
18, . . . O-rings;
19, . . . adhesive tape;
21, . . . winding core;
22, . . . roll-shaped silver halide photosensitive material;
23, . . . protective board ("ate boru");
24, . . . adhesive tape;
25, . . . disc-shaped corrugated board sheet;
26, . . . perforated film with a flange for a lateral side;
27, . . . moisture-proofing light-shielding film with a flange for a lateral side;
28, . . . moisture-proofing light-shielding film;
29, . . . adhesive tape;
30, . . . adhesive tape;
31, . . . both lateral side ends;
32, . . . adhesive tape;

33, . . . disc-shaped corrugated board sheet;
34, . . . perforated film for a lateral side;
35, . . . moisture-proofing light-shielding film;
36, . . . adhesive tape;
37, . . . adhesive tape;
41, . . . winding core;
42, . . . roll-shaped silver halide photosensitive material;
43, . . . protective board;
44, . . . moisture-proof light-shielding film;
45, . . . disc-shaped corrugated board sheet;
46, . . . perforated film with a flange for a lateral side;
47, . . . disc-shaped corrugated board sheet;
48, . . . perforated film for a lateral surface;
49, . . . rain-water proofing transparent polyethylene resin film;
50, . . . moisture-proofing light-shielding film;
51, . . . moisture-proofing light-shielding film;
52, . . . disc-shaped thick type corrugated board sheet;
53, . . . rounded pallet;
54, . . . moisture-proofing light shielding film;
55, . . . moisture-proofing light shielding film;
61, . . . liner (kraft liner 130g/m$^2$;
62, . . . corrugated medium (kraft paper 130g/m$^2$);
63, . . . adhesive (corn starch adhesive for the corrugated cardboard sheet);
64, . . . lacquer finishing;
65, . . . vuleanized fiber stock (1.2 wound);
66, . . . core paper (thickness 30 mm);
67, . . . cap;
68, . . . 52 pores;
69, . . . 44 pores;
70, . . . 36 pores;
71, . . . 32 pores;
72, . . . 24 pores;
73, . . . 22 pores.

DETAILED DESCRIPTION OF THE PREFERRED EMBODIMENTS

Referring to the drawings, preferred embodiments of the packaged roll-shaped silver halide photosensitive material according to the present invention will be explained in more detail. FIGS. 1 to 4, FIGS. 5 to 9 and FIGS. 10 and 12 to 19 illustrate the following first, second and third embodiments, respectively. However, the present invention is by no means limited to these specified embodiments.

First Embodiment

Figure 2:
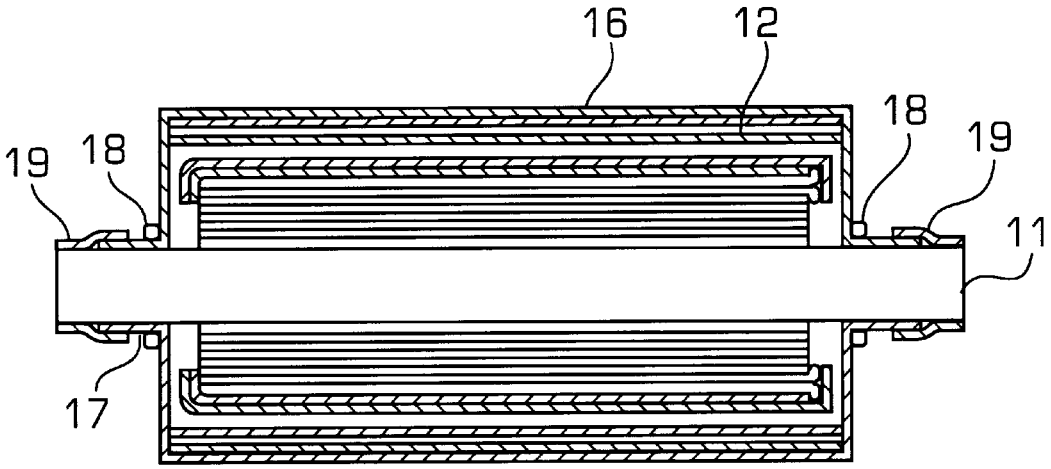
FIG. 2 is a schematic cross-sectional view showing an example of a first embodiment according to the present invention.
Figure 3:
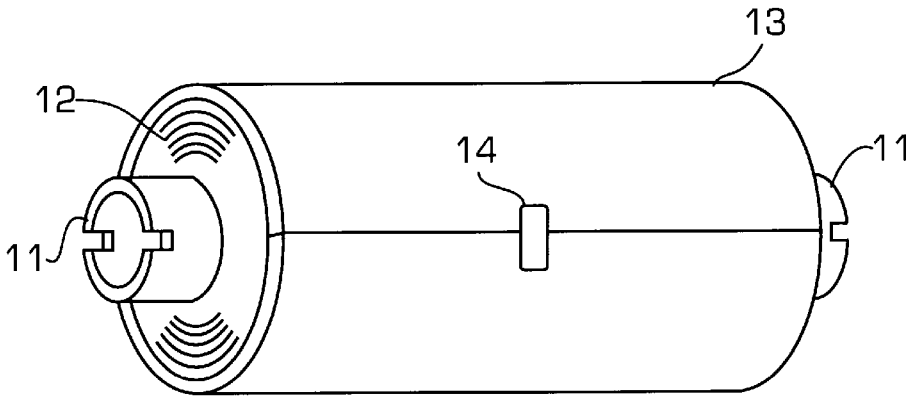
FIG. 3 is a schematic perspective view showing a production process for an example of the first embodiment of the present invention.
Figure 4:
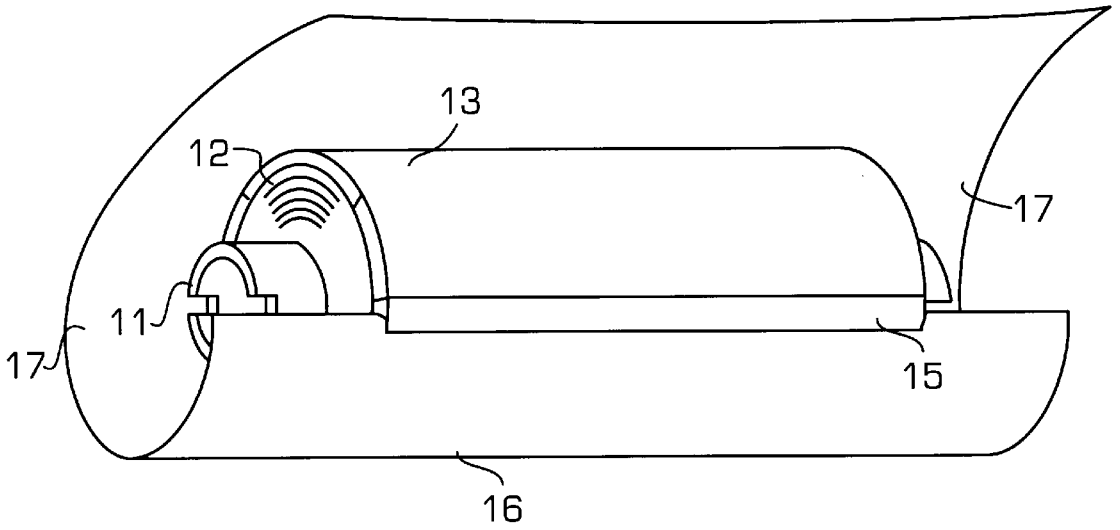
FIG. 4 is another schematic perspective view showing a production process for an example of the first embodiment of the present invention.

FIGS. 1 and 2 show an embodiment of a packaged roll-shaped silver halide photosensitive material in a perspective view and in a cross-sectional view, respectively. FIGS. 3 and 4 illustrate the production process in a perspective view. On a winding core 11 is wound a roll-shaped silver halide photosensitive material 12 on the peripheral surface of which a protective board ("ate boru": paper material, for example, unbleached kraft paper or cardboard) 13 is wound in several turns. The lateral-side ends of the protective board 13 are bent inwards by approximately 90° inwards for covering the outer lateral edge of the roll-shaped silver halide photosensitive material 12. The protective board 13 has its inchoate end secured with an adhesive tape to the terminal end of the roll-shaped silver halide photosensitive material 12, while having its terminal end secured with an adhesive tape 14 to the protective board 13 itself. A fine-pore film 16, having its inchoate end secured with an adhesive tape several times on the peripheral surface of the protective board 13, and has its lateral side ends 17, 17 secured with O-rings 18, 18 on the proximal end of the winding core 11, while having its both distal ends secured with adhesive tapes 19, 19 to the winding core 11.

For fabricating the above-described packaged roll-shaped silver halide photosensitive material, after the inchoate end of the protective board 13 is secured to the terminal end of the roll-shaped silver halide photosensitive material 12, and the board 13 is wound thereon several times, the lateral side of the corrugated board sheet is bent for covering the outer edge of the lateral surface of the roll-shaped silver halide photosensitive material 12, and then the terminal end of the corrugated board sheet is secured with the adhesive tape 14 to the protective board 13 itself, as shown in FIG. 3.Then, after securing the inchoate end of the fine-pore film 16 to the board 13 itself with the adhesive tape 15, as shown in FIG. 4, the film is wound several times, and the lateral side ends 17 of the fine-pore light-shielding film 16, protruded laterally from the roll-shaped silver halide photosensitive material 12, are brought into substantially tight contact with the lateral sides of the roll-shaped silver halide photosensitive material 12 and the winding core 11 the lateral side ends 17 are secured with O-rings 18 to the proximal ends of the winding core 11, while the lateral distal ends thereof are secured with the adhesive tape 19 to the winding core 11 (FIGS. 1 and V2 ). The roll-shaped silver halide photosensitive material, thus packaged, can be stored and transported.

Second Embodiment

Figure 5:
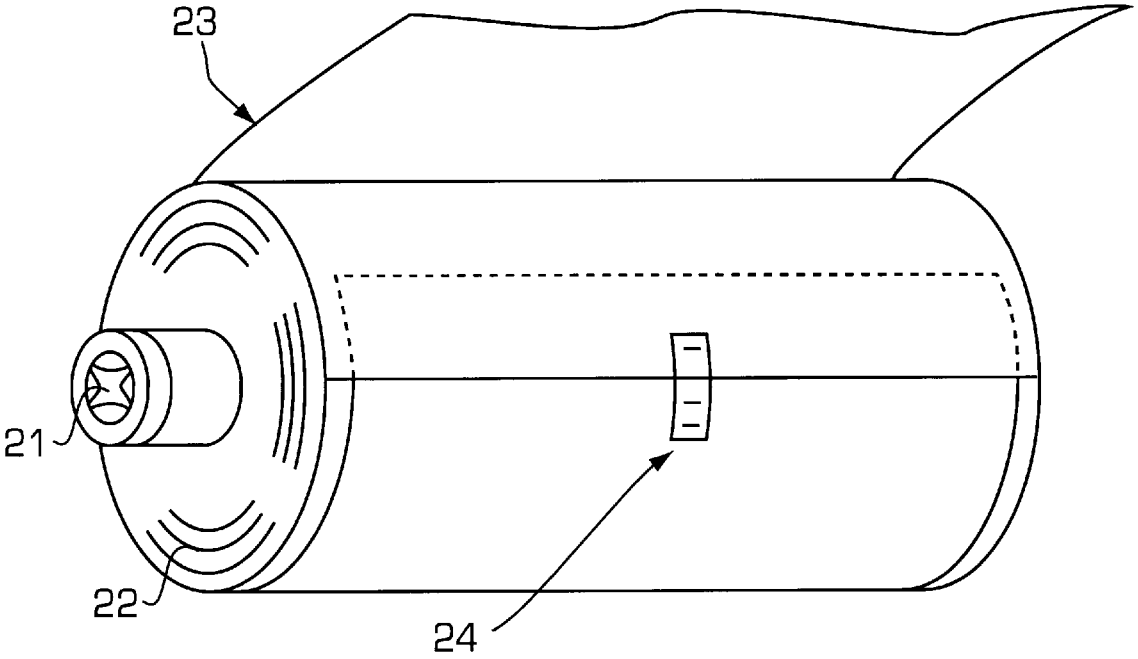
FIG. 5 is a schematic perspective view showing a production process for an example of the second embodiment of the present invention.
Figure 6:
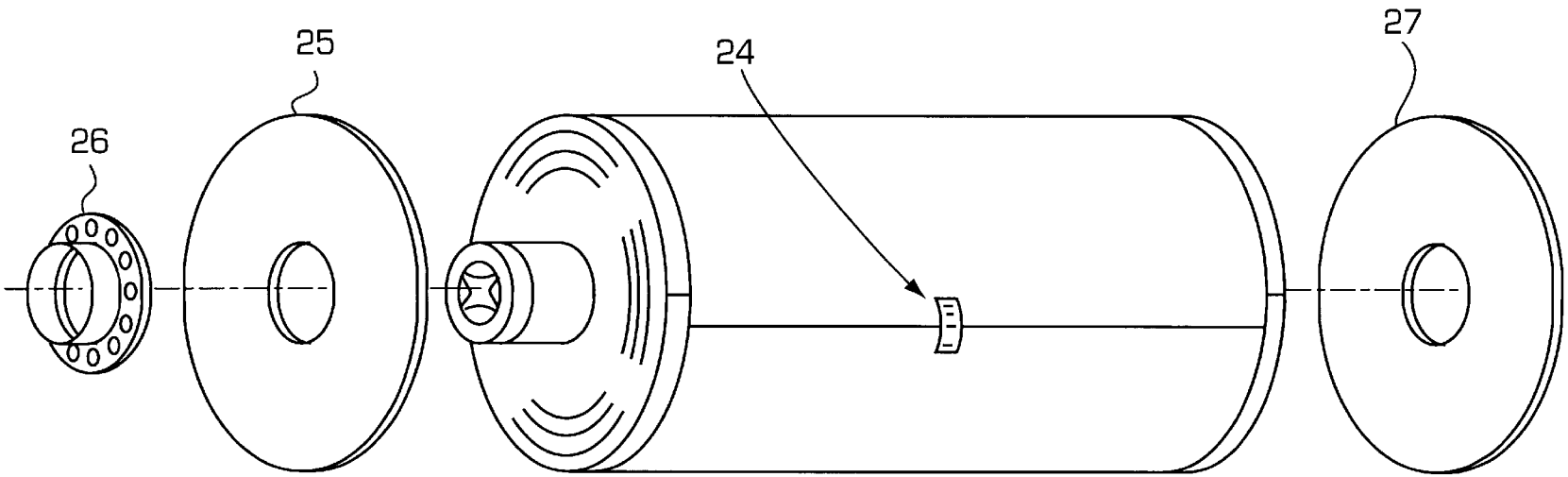
FIG. 6 is another schematic perspective view showing a production process for an example of the second embodiment of the present invention.
Figure 7:
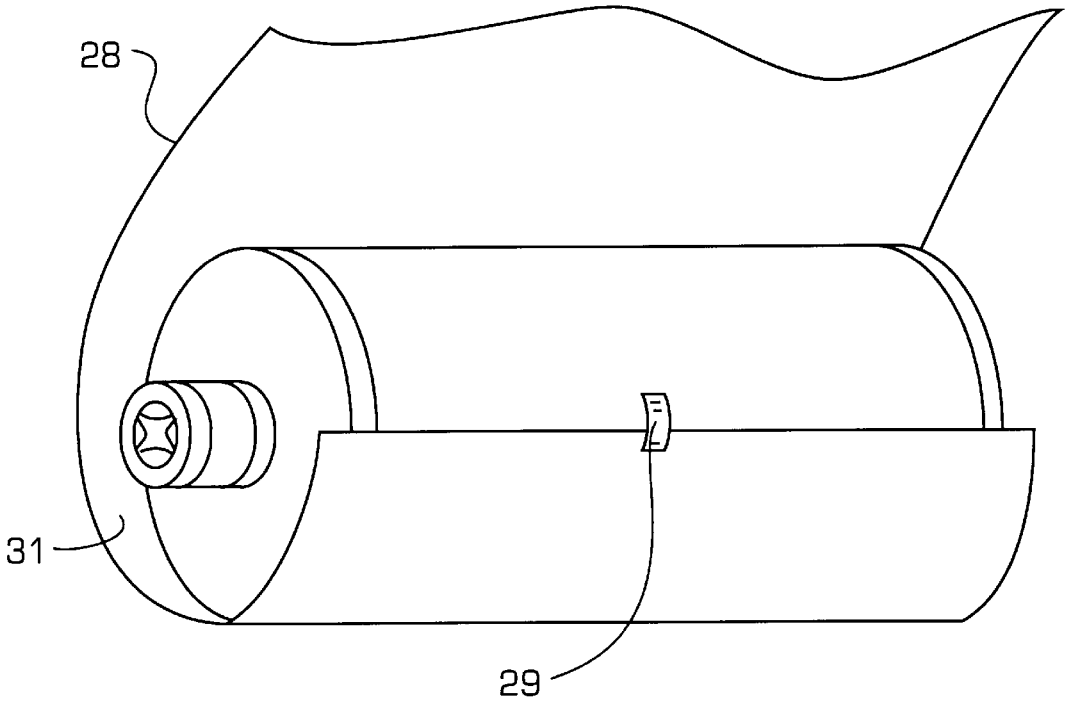
FIG. 7 is still another schematic perspective view showing a production process for an example of the second embodiment of the present invention.
Figure 8:
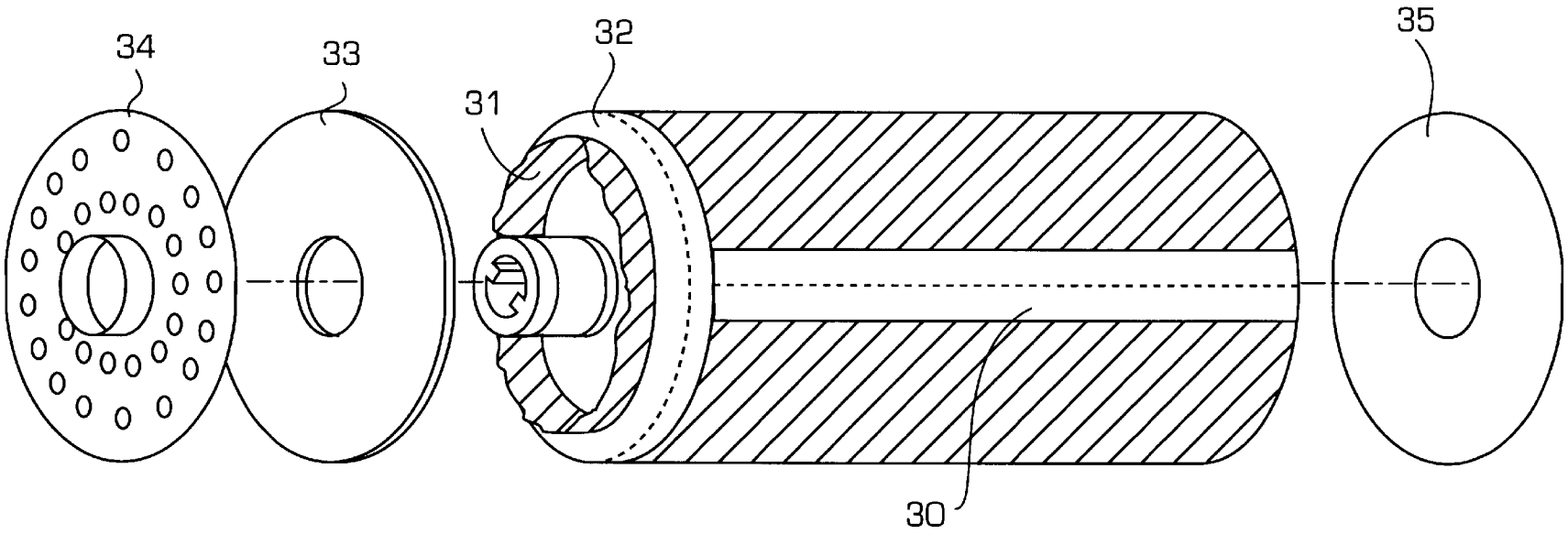
FIG. 8 is still another schematic perspective view showing a production process for an example of the second embodiment of the present invention.
Figure 9:
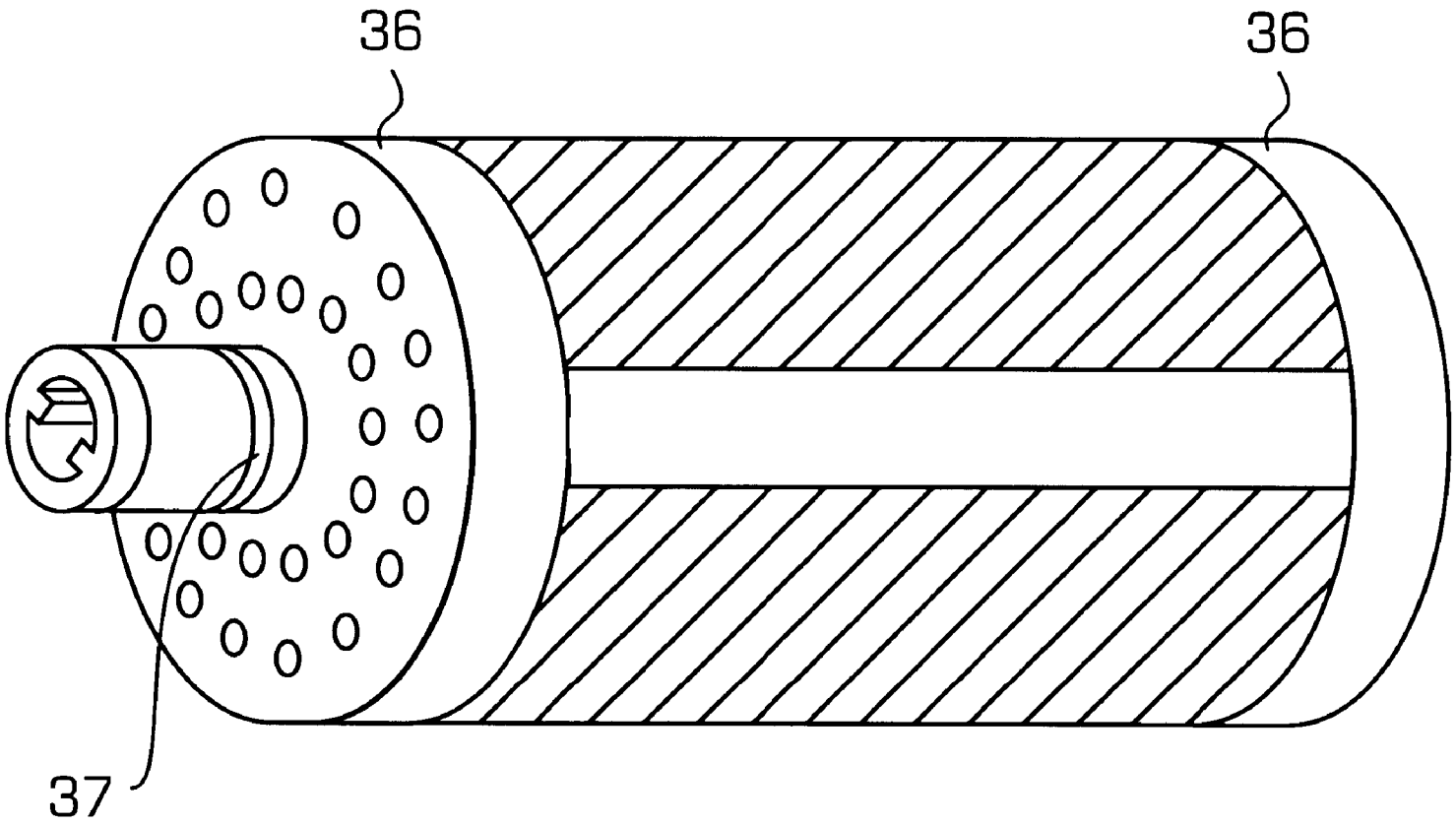
FIG. 9 is a perspective view showing an embodiment of the second embodiment of the present invention.

FIG. 9 is a perspective view showing an embodiment of the packaged roll-shaped silver halide photosensitive material, while FIGS. 5 to 8 illustrate the process for producing the packaged the roll-shaped silver halide photosensitive material 22. A winding core 21 (FIG. 5) has a longitudinal axis longer than the transverse width of the roll-shaped silver halide photosensitive material 22. A silver halide photosensitive material 22 (FIG. 5) is wound about the peripheral surface of the winding core 21 (FIG. 5), while a protective board ("ate boru": paper material, for example, unbleached kraft paper or cardboard) 23 (FIG. 5) is wound about the peripheral surface of the silver halide photosensitive material 22. The protective board 23 has its terminal end secured with an adhesive tape 24 to itself (FIG. 5). On one lateral side of the roll-shaped silver halide photosensitive material 22 (FIG. 5), a disc-shaped corrugated board sheet 25 (FIG. 6) having a circular center aperture designed to be passed through by the winding core and a perforated light-shielding film 26 (FIG. 6) for the flanged lateral side having a circular center aperture designed to be passed through by the winding core, are passed through by the winding core 21 (FIG. 5) so as to sequentially overlie the lateral side of a roll-shaped silver halide photosensitive material 22 (FIG. 5). On the opposite lateral side of the roll-shaped silver halide photosensitive material 22 (FIG. 5), a moisture-proofing light-shielding film 27 (FIG. 6) having a circular center through-hole that can be passed through by the winding corrugated medium is passed through by the winding core 21 (FIG. 5) to cover the lateral side of the roll-shaped silver halide photosensitive material 22 (FIG. 5). On the peripheral surface of the protective board 23 (FIG. 5), a moisture-proofing light-shielding film 28 (FIG. 7), having a transverse width longer than the transverse width of the roll-shaped silver halide photosensitive material 22 (FIG. 5), is wound several times and has its inchoate end secured to the protective board 23 (FIG. 5) with an adhesive tape 29

(FIG. 7) while having its terminal end secured by an adhesive tape 30 (FIG. 8) to the moisture-proofing light-shielding film 28 (FIG. 7) itself (FIG. 7). The moisture-proofing light-shielding film has its both lateral side ends 31, 31 (FIG. 7) bent approximately 90° inwards and adhesive tapes 32, 32 (FIG. 8) are wound several times on the bent portion (FIG. 8). On the lateral side of the photosensitive material 22 (FIG. 5), provided with the disc-shaped corrugated board sheet 25 (FIG. 6) and the perforated light-shielding film 26 (FIG. 6) for the flanged surface, a disc-shaped corrugated board sheet 33 (FIG. 8) having a center through-hole adapted to be passed through by the winding core and a perforated light-shielding film 34 (FIG. 8) for a lateral side having a center circular though-hole adapted to be passed through by the winding core, are sequentially passed through by the winding core 21 (FIG. 5). The portions of the moisture-proofing light-shielding film 28 (FIG. 7) protruded beyond the lateral side ends of the moisture-proofing light-shielding film 28 (FIG. 7) are bent for covering the outer surfaces of the perforated light-shielding film 26 (FIG. 6) for the flanged surface (FIG. 8). The disc-shaped corrugated board sheet 33 (FIG. 8) and the perforated light-shielding film 34 (FIG. 8) for the lateral surface have the outer periphery thereof secured with an adhesive tape 36 (FIG. 9) to the moisture-proofing light-shielding film 28 (FIG. 7) and with the adhesive tape 37 (FIG. 9) to the winding core 21 (FIG. 5). The moisture-proofing light-shielding film 35 (FIG. 8) for the lateral surface is secured to the moisture-proofing light-shielding film 28 (FIG. 7) and to the winding core 21 (FIG. 5) by an adhesive tapes 36 (FIG. 9) and 37 (FIG. 9), respectively (FIG. 9).

Third Embodiment

Figure 10:
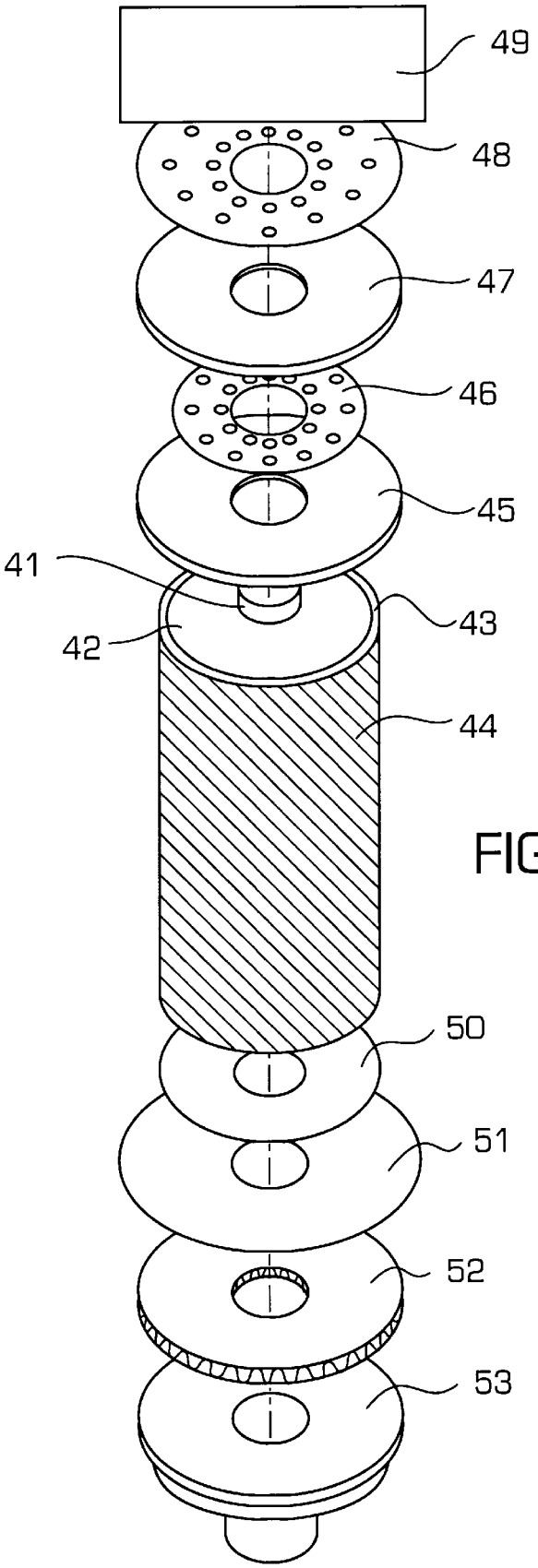
FIG. 10 is a schematic perspective view showing the structure of an example of a third embodiment of the present invention.

FIG. 10 schematically shows the structure of an embodiment of a packaged roll-shaped silver halide photosensitive material. The columnar-shaped photosensitive material is set upright (with the axial direction of the winding core oriented in a vertical direction relative to the ground surface) and is reinforced on its lower lateral surface for convenience in transportation and storage. A roll-shaped silver halide photosensitive material 42 is placed around the winding core 41 while the peripheral surface of the roll-shaped silver halide photosensitive material 42 is wound several times with a protective board ("ate boru": paper material, for example, unbleached kraft paper or cardboard) 43. A moisture-proofing light-shielding film 44 is wound several times on the peripheral surface of the protective board 43. On one lateral side (upper lateral side) of the roll-shaped silver halide photosensitive material 42, a disc-shaped corrugated board sheet 45, a perforated light shielding film 46 for a flanged lateral side, a disc-shaped corrugated board sheet 47, a perforated film 48 for a lateral side 48, having center circular through-holes that can be passed through by the winding core, are sequentially passed through by the winding core 41 to sheath the lateral side of the roll-shaped silver halide photosensitive material 42. The lateral surface of the roll-shaped silver halide photosensitive material 42 is covered with a film 49 not to affect the property of the transmittance to moisuture, the laterally protruded portion of which is bonded to the moisture-proofing film 44 with an adhesive tape for moisture proofing purposes. On the opposite lateral side (lower lateral side) of the roll-shaped silver halide photosensitive material 42, a moisture-proofing light-shielding film for a lateral surface 50, another moisture-proofing light-shielding film for a lateral surface 51, a disc-shaped corrugated board sheet 52 and a rounded pallet 53, each having a center circular through-hole that can be passed through by a winding core, are sequentially passed through by the winding core 41 so as to cover the lateral side of the roll-shaped silver halide photosensitive material 42.

EXAMPLES

Referring to the drawings, several examples of the packaged roll-shaped silver halide photosensitive material according to the present invention will be explained. The present invention is, however, not limited to these examples.

FIG. 1 shows, in a perspective view, the packaged roll-shaped silver halide photosensitive material of the first embodiment, while FIG. 2 shows the same in cross-section. FIGS. 3 and 4 illustrate the production process. In the following Example 1, this configuration is used. In the Comparative Examples 3, 5 and 6, this configuration is again used, with the use of a moisture-proofing light-shielding film in place of the fine-pore film 16.

FIG. 9 shows, is a perspective view, the packaged roll-shaped silver halide photosensitive material of the second Embodiment, while FIG. 5 to 8 illustrate the production process. In the Examples 2 to 4 and in the comparative Examples 1 and 2, this configuration is used. In the Examples 2 to 4, a transmittance to moisture material is used as a material covering the lateral side of the perforated film for a lateral side 34. In the Comparative Examples 1 and 2, a moisture-proofing material is used as a material for covering the lateral side of the perforated film for a lateral surface 34.

Figure 11:
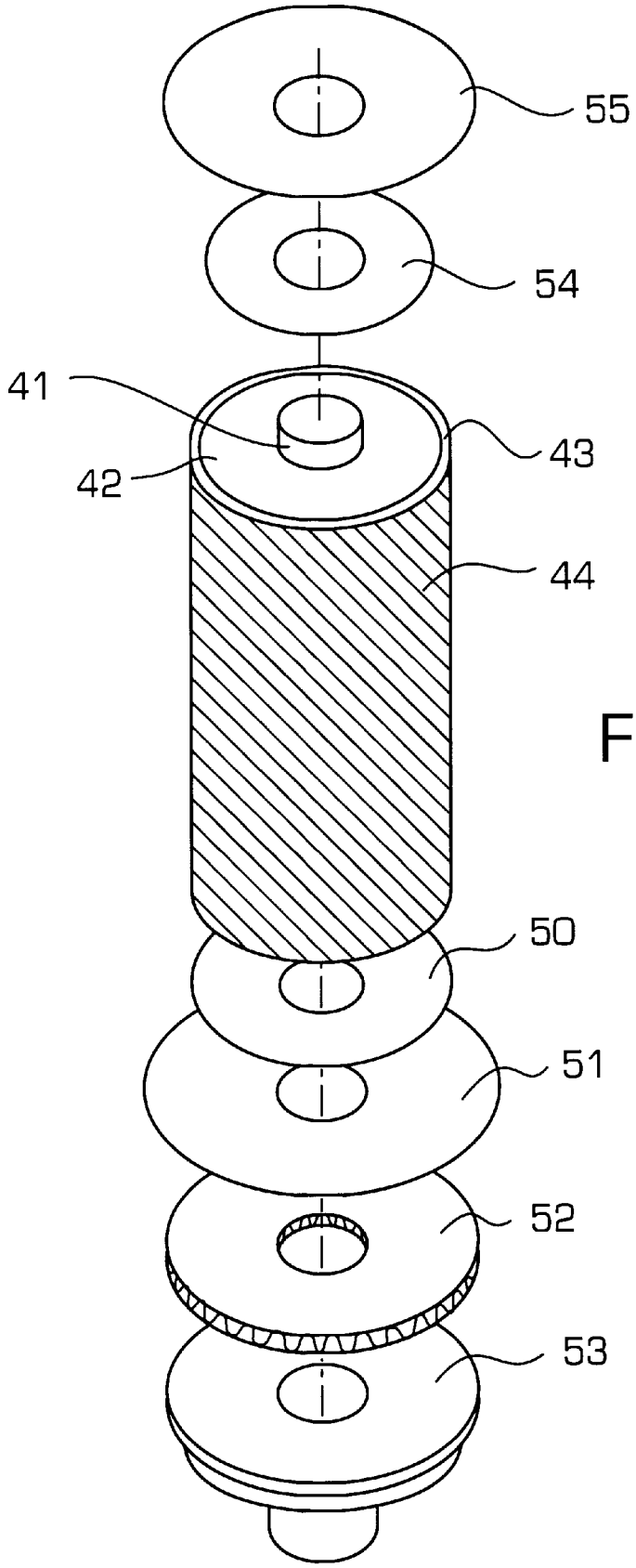
FIG. 11 is a schematic perspective view showing the structure of a comparative example of the present invention.
Figure 12:
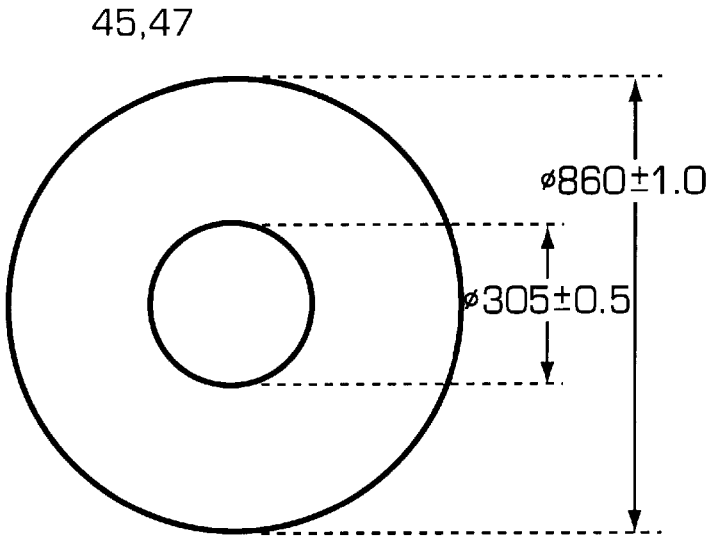
FIG. 12 schematically shows an upper corrugated board sheet in an example of a third embodiment of the present invention.
Figure 13:
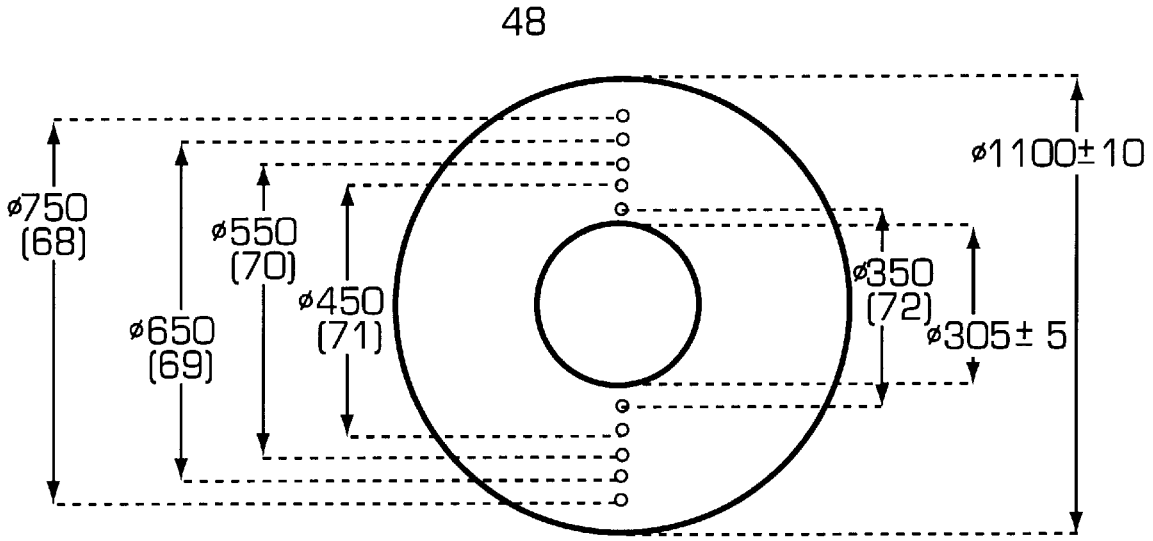
FIG. 13 schematically illustrates an upper perforated film (of large format) in an example of the third embodiment of the present invention.
Figure 14:
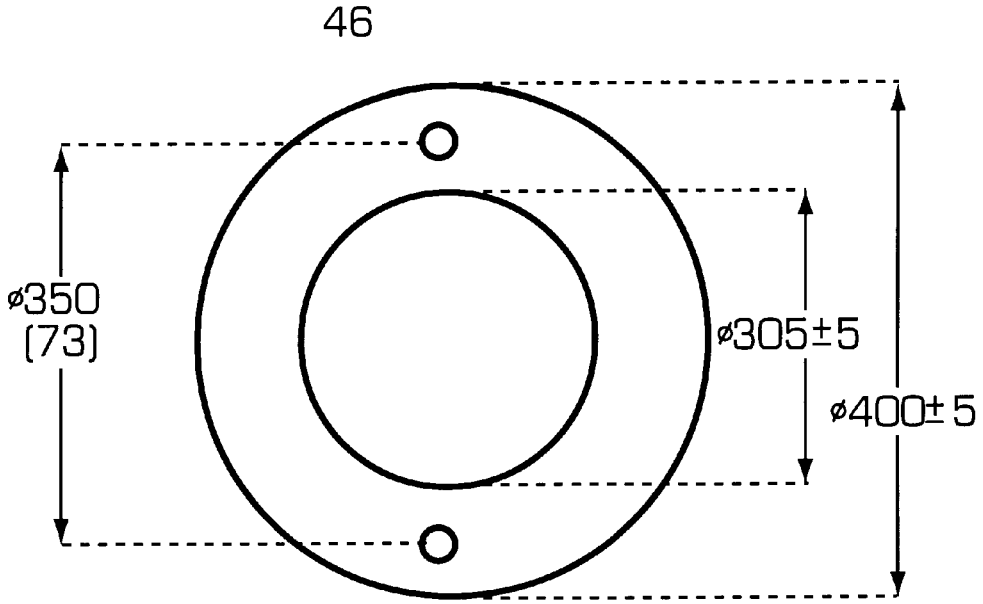
FIG. 14 schematically illustrates an upper perforated film (of small format) in an example of the third embodiment of the present invention.

FIG. 10 shows, in perspective, the structure of the packaged roll-shaped silver halide photosensitive material of the third embodiment. The Example 5 corresponds to this configuration. FIGS. 12 to 19 show the material used in Example 5 used in the configuration in FIG. 10. FIG. 11 shows the packaged roll-shaped silver halide photosensitive material used in the Comparative Example 4 which differs from Example 3 only with respect to a lateral side (upper lateral side, that is a lateral side having the perforated film for the lateral surface). That is, on the above-mentioned one lateral side of the roll-shaped silver halide photosensitive material 42, a moisture-proofing light-shielding film 54 for a lateral side and another moisture-proofing light-shielding film 55 for a lateral side, each having a center circular through-hole that can be passed through by a winding core, are passed through sequentially through the winding core 41 for covering the lateral side of the roll-shaped silver halide photosensitive material 42.

Figure 20:
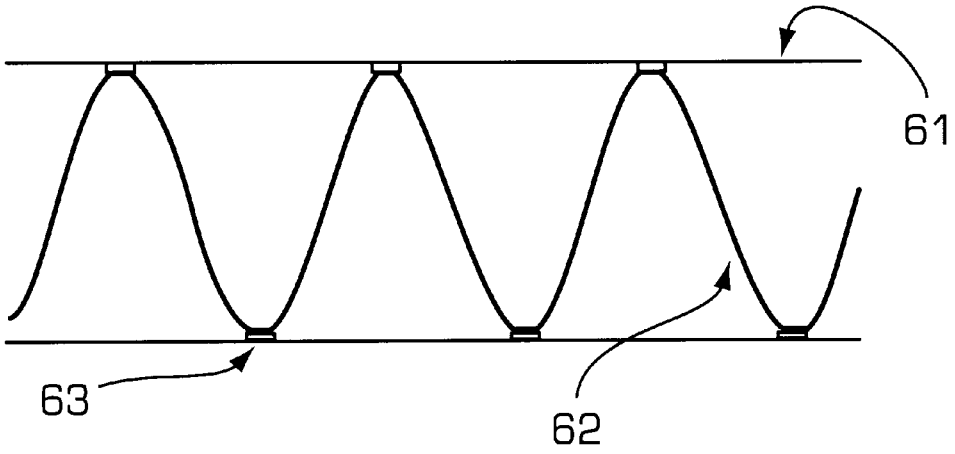
FIG. 20 is a schematic cross-sectional view showing a corrugated board sheet according to an embodiment of the present invention.

FIG. 20 shows, in cross-section, an E-flute corrugated board sheet employed in each of the Examples 2 to 5 and Comparative Examples 1 and 2. The corrugated board sheet is made up of a kraft liner 61 of 130 g/m$^2$ and a corrugated medium 62 of kraft paper of 130 g/m$^2$ bonded together with a corn starch adhesive 63 for the corrugated board sheet.

Figure 21:
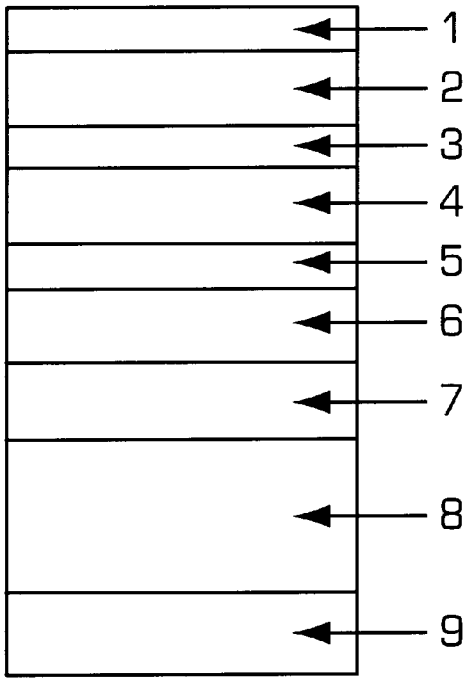
FIG. 21 PRIOR ART
FIG. 21 is a schematic cross-sectional view showing a layered structure of a color photographic paper.

FIG. 21 shows respective layers of a color photographic paper sheet in cross-section. The color photographic paper sheet is made up of six layers, inclusive of a protective layer and an intermediate layer. The respective layers are coated finely to high precision, with the total thickness being on the order of 10 $\mu$m. The light from an emulsifier surface enters the color photographic paper sheet through a route of from a protective layer 1 to a substrate (polyethylene layers 7 and 9 and a paper layer 8) through a red-sensitive layer 2, an intermediate layer 3, a green-sensitive layer 4, an intermediate layer 5 and a blue-sensitive layer 6 in this order.

Example 1

In the packaged roll-shaped silver halide photosensitive material of Example 1, the winding core 11 of a diameter of 300 mm and a length of 1620 mm was used, while the roll-shaped silver halide photosensitive material 12 was a roll of a color photographic paper sheet (containing salt silver bromide with bromine contents of 8 mol %) having a winding length of 3000 m, width of 1500 mm and a winding diameter of 850 mm with a self weight of 1200 kg. The protective board ("ate boru", paper material) 13 used was an unbleached kraft paper of 70 g/m$^3$ not affecting the photographic performance. The protective board 13 was wound twice. The fine-pore film 16 used was a film formed of a low-density homopolyethylene resin containing carbon black not affecting photographic performance and having a transmittance to moisture of 7.3 g/m$^2$·24 hours (as measured at 40° C. and 90% RH as prescribed in JIS Z-0208) and a thickness of 60 $\mu$m. This film was wound once.

Examples 2 to 4

In the packaged roll-shaped silver halide photosensitive material of Example 1, the winding core 21 of a diameter of 300 mm and a length of 1620 mm was used, while the roll-shaped silver halide photosensitive material 22 was a roll of a color photographic paper sheet (containing salt silver bromide with bromine contents of 8 mol %) having a winding length of 3000 m, width of 1500 mm and a winding diameter of 850 mm with a self weight of 1200 kg. The protective board ("ate boru"; paper material) 23 used was an crude kraft paper of 70 g/m$^3$ not affecting the photographic performance. The board 23 was wound twice. The moisture-proofing light-shielding film 28 used was a film formed of a light-shielding low-density homopolyethylene resin not affecting photographic performance and having a transmittance to moisture of 3.5 g/m$^2$·24 hours (as measured at 40° C. and 90% RH as prescribed in JIS z-0208) and a thickness of 120 $\mu$m. This film was wound once.

A roll-shaped silver halide photosensitive materials were prepared for in Examples 2 to 4 in the same way as described above except using a different material from that of Example 1 as the packaging material covering the lateral side of the perforated film 34 for the lateral surface. The packaging material covering the lateral surface for Example 2 was an E-fluted corrugated board sheet superposed on a perforated polyethylene film with a thickness of 120 $\mu$m (with a transmittance to moisture at 40° C. and 90% RH according to JIS Z-0208 of 12 g/m$^2$·24 hours), that for Example 3 was an E-fluted corrugated board sheet superposed on a bi-axially stretched fine-pore polyethylene film of 50 $\mu$m in thickness, containing 30 wt % of an inorganic filler kneaded therein (with a transmittance to moisture at 40° C. and 90% RH according to JIS Z-0208 of 19 g/m$^2$·24 hours), and that for Example 4 was an E-fluted corrugated board sheet superposed on a laminated film of a fine-pore polyethylene film and a non-woven fabric(with a transmittance to moisture at 40° C. and 90% RH according to JIS Z-0208 of 18 g/m$^2$·24 hours).

The above polyethylene film contains the light-shielding material and is colored black.

Comparative Examples 1 and 2

A packaged roll-shaped silver halide photosensitive material, prepared in the same way as in Example 2 except using a different moisture-proofing material for the packaging material covering the lateral side thereof directed towards the perforated film 34 for a lateral side, was used for the Comparative Examples 1 and 2. The moisture-proofing packaging material covering the lateral surface for Comparative Example 1 was an E-fluted corrugated board sheet superposed on a polyethylene film with a thickness of 120 $\mu$m (having a transmittance to moisture according to JIS Z-0208 at 40° C. and 90% RH) of 2.7 g/m$^2$·24 hours), while that for Comparative Example 2 was superposed E-fluted corrugated board sheet and a laminated film of L-LDPE with a thickness of 40 $\mu$m, a PET with a thickness of 16 $\mu$m and an L-LDPE with a thickness of 40 $\mu$m (with a transmittance to moisture at 40° C. and 90% RH according to JIS z-0208 of 3.1 g/m$^2$·24 hours).

Comparative Example 3

In the packaged roll-shaped silver halide photosensitive material of Example 1, the winding core 11 of a diameter of 300 mm and a length of 1620 mm was used, while the roll-shaped silver halide photosensitive material 12 was a roll of a color photographic paper sheet (containing salt silver bromide with bromine contents of 8 mol %) having a winding length of 3000 m, width of 1500 mm and a winding diameter of 850 mm with a self weight of 1200 kg. The protective board 13 used was an crude kraft paper of 70 g/m$^3$ not affecting the photographic performance. The board 13 was wound twice. A moisture-proofing light-shielding film was used in place of the fine-pore film 16. The moisture-proofing light-shielding film used was a film of low-density homopolyethylene resin with a thickness of 120 $\mu$m made up of 600 ppm of fatty acid amides and 3 wt % of furnace carbon black with MFR of 2.0 g/10 minutes and a density of 0.922 g/cm$^2$ for not affecting photographic performance. This film was wound thrice. The film exhibited transmittance to moisture at 40° C. and RH of 90% of according to JIS Z-0208 of 1.04 g/m$^2$·24 hours.

Example 5

Figure 15:
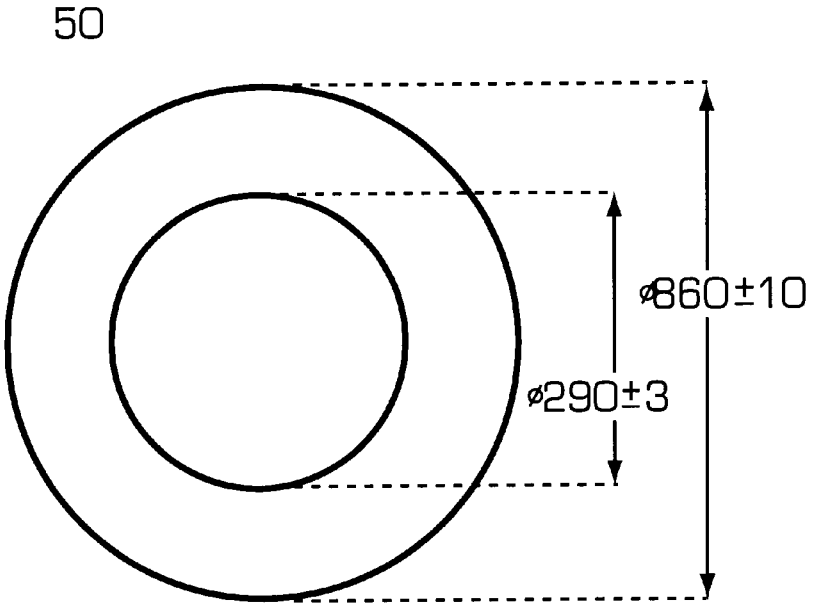
FIG. 15 schematically shows a lower light-shielding film (medium size) in an example of the third embodiment of the present invention.
Figure 16:
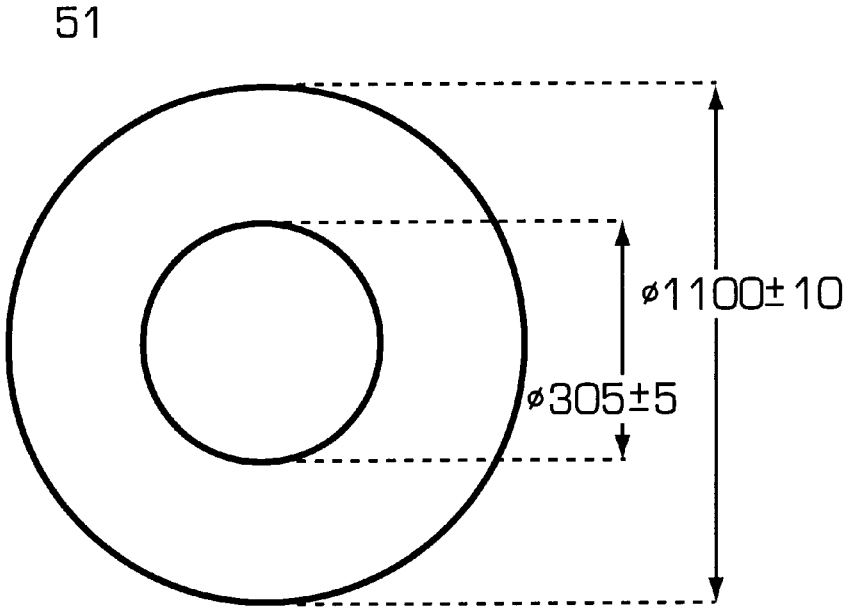
FIG. 16 schematically shows a lower light-shielding film (large size) in an example of the third embodiment of the present invention.
Figure 17:
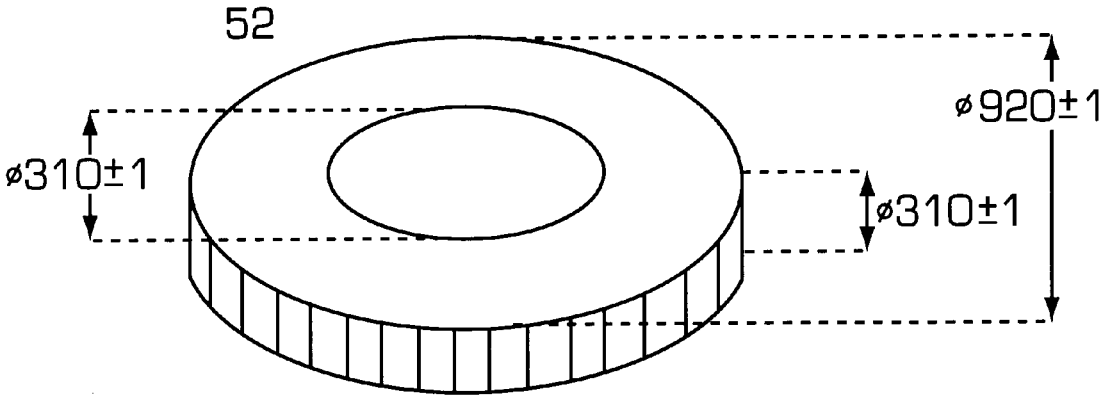
FIG. 17 is a schematic perspective view showing a lower thick-type corrugated board sheet according to an embodiment of the third embodiment of the present invention.
Figure 18:
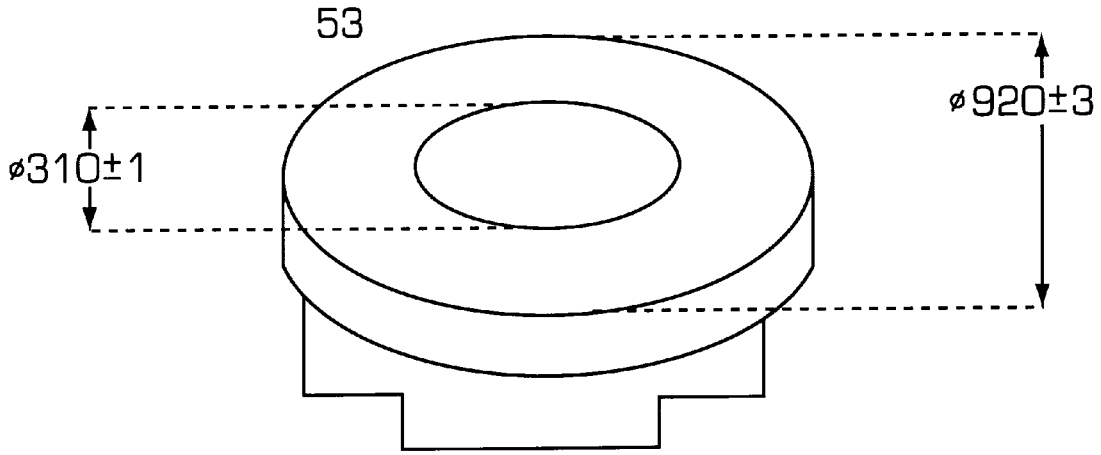
FIG. 18 is a schematic perspective view of a rounded pallet according to an embodiment of the third embodiment of the present invention.
Figure 19:
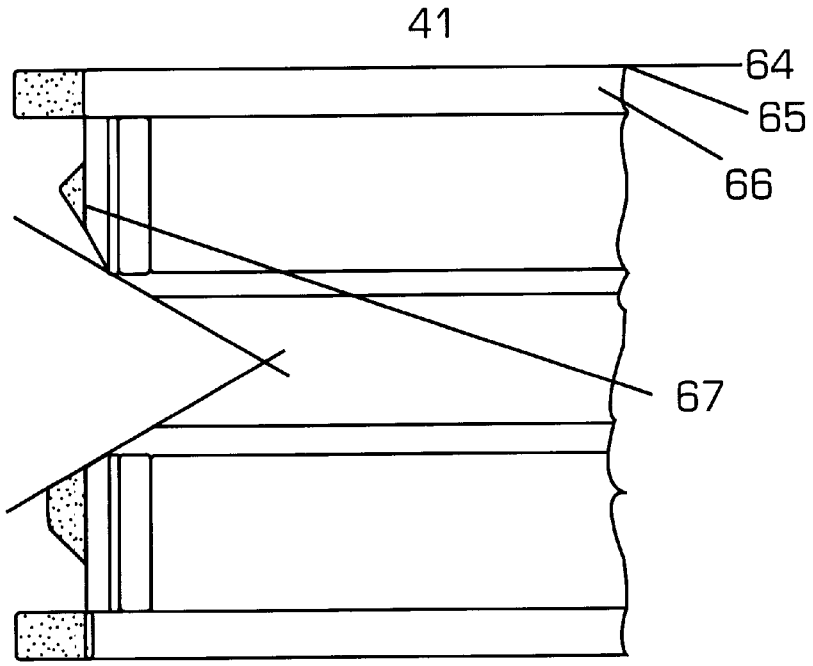
FIG. 19 is a schematic cross-sectional view of a winding core according to an example of a third embodiment of the present invention.

Referring to FIG. 10,showing a packaged roll-shaped silver halide photosensitive material of the third embodiment, a medium-sized black-colored light-shielding polyethylene resin film 50 (with a thickness of 120 $\mu$m, as shown in FIG. 15) and a large-sized black-colored light-shielding polyethylene resin film 51 (with a thickness of 120 $\mu$m, as shown in FIG. 16) were laid on the lower lateral side of the packaged material, while a particularly thick corrugated board sheet 52 (shown in FIG. 17) having a center through-hole passed through by a winding core 41 (shown in FIG. 19) was laid on the lower side of the packaged material. On the upper lateral side of the packaged material were laid an E-fluted corrugated board sheet 45 (shown in FIG. 12), a small-sized perforated black-colored polyethylene resin film 46 (having a thickness of 80 $\mu$m, shown in FIG. 14), an E-fluted corrugated board sheet 47 (shown in FIG. 12), a large-sized perforated black-colored polyethylene resin film 48 (shown in FIG. 13) and a rain-water proofing transparent polyethylene resin film 49, in this order, in order to produce a packaged roll-shaped silver halide photosensitive material having transmittance to moisture at 40° C. and RH of 90% according to JIS Z-0208 of 10.6 g/m$^2$·24 hours.

Comparative Example 4

A packaged roll-shaped silver halide photosensitive material different from Example 5 only with respect to the upper lateral surface was prepared (Fig.11). That is, a medium-sized black-colored light-shielding polyethylene resin film 54 (120 $\mu$m in thickness) and a large-sized black-colored light-shielding polyethylene resin film 55 (120 $\mu$m in thickness) were laid on the upper lateral side. The transmittance to moisture of the resulting packaged roll-shaped silver halide photosensitive material according to JIS Z-0202 (40° C., 90% RH) was 2.1 g/m$^2$·24 hours.

Comparative Examples 5 and 6

A packaged roll-shaped silver halide photosensitive material was prepared in the same way as in Comparative Example 3 except using a roll-shaped silver halide photosensitive material of different silver halide content, as Comparative Examples 5 and 6. While the material in the Comparative Example 3 contained 97% of silver chloride, the materials of the Comparative Examples 5 and 6 contained 80% and 25% of silver halide, respectively. The transmittance to moisture of the resulting packaged roll-shaped silver halide photosensitive materials of the Comparative Examples 5 and 6 according to JIS Z-0202 (40° C., 90% RH) was 1.04 $g/m^2 \cdot 24$ hours, as in Comparative Example 3.

Relative Sensitivity Measurement Test

A relative sensitivity measurement test was conducted for measuring the effect of preventing abnormal sensitization in the photographic performance of the packaged roll-shaped silver halide photosensitive material of the present invention in connection with the Examples 1 to 5 and Comparative Examples 1 to 5. The packaged roll-shaped silver halide photosensitive materials, obtained on packaging the roll-shaped silver halide photosensitive material 12, were allowed to stand stationarily for ten days at a temperature of 40° C. and an RH of 50% in connection with the Examples 1 to 5 and Comparative Examples 1 to 5. From the packaged roll-shaped silver halide photosensitive materials of the Examples 1 to 5 and Comparative Examples 1 to 5, the silver halide photosensitive materials were taken out and exposed to light for 0,1 second, using a tungsten bulb, at a luminosity of 6000 lux, via color separation filters of blue (B), green (G) and red (R) and a silver-vaporized wedge exhibiting continuously varying density. The silver halide photosensitive materials were then developed. Silver halide was developed for coloration at 35° C. for 45 seconds, using a color paper processing agent CP-45X produced by FUJI PHOTOGRAPHIC FILM CO. LTD. After development, silver halide was bleached at 35° C. for 45 seconds and washed with water at 30° C. for 3 minutes so as to be then dried in warm air flow at 80° C. As for salt silver bromide, it was dried by blowing hot air of 80° C. after coloration development at 33° C. for 3 minutes 30 seconds, employing a color paper processing agent CP-20A produced by FUJI PHOTOGRAPHIC FILM CO. LTD., followed by bleaching and fixing at 33° C. for one minute 30 seconds, followed in turn by washing with water at 30° C. for three minutes. The density values of yellow, magenta and cyan colorants, respectively corresponding to light exposure with B (blue), G (green) and R (red) light, were subsequently measured using a TCD reflection type densitometer, and logarithmic values of the light exposure corresponding to the density value of 0.5 were taken by way of measuring the relative sensitivity.

Measurement of Light-Shielding Performance

Measurement tests for the light-shielding performance were conducted for measuring the light-shielding performance of the packaged roll-shaped silver halide photosensitive material according to the present invention with respect to Examples 1 to 5 and Comparative Examples 1 to 5. The packaged photosensitive materials of Examples 1 to 5 and Comparative Examples 1 to 5, produced on packaging the roll-shaped silver halide photosensitive material, were exposed to the sunlight of 80,000 lux for two hours and subsequently the roll-shaped silver halide photosensitive material was developed to observe and judge possible presence of abnormality in the light fogging or photographic performance.

Result

The results of the relative sensitivity measurement test and light-shielding performance test were evaluated by the following methods. That is, evaluation by the following five stages was made in the relative sensitivity measurement test:

(Standard for Evaluation of Relative Sensitivity Measurement Test)

⊚ relative sensitivity 100 (no changes in sensitivity; excellent)

○ relative sensitivity 100±1 (extremely small changes in sensitivity; satisfactory)

● relative sensitivity 100±2 (changes in sensitivity small; practically acceptable)

Δ relative sensitivity 103 to 105 (changes in sensitivity significant; improvement is required)

x relative sensitivity 106 or more (changes in sensitivity extremely significant; practically unusable)

In light-shielding performance measurement test, no test samples were outside the usable limit. Therefore, evaluation was made in the following three stages:

(Evaluation Standard of Light-Shielding Performance)

⊚ excellent

○ satisfactory

● practically usable

The above results are shown in the following Tables 1 and 2:

TABLE 1

| | Examples | | | | |
|---|---|---|---|---|---|
| Eample No. | 1 | 2 | 3 | 4 | 5 |
| Embodiment No. | 1 | 2 | 2 | 2 | 3 |
| Materials Types of Packaging Materials | Unbleached kraft paper LDPE Fine-pore film | E-flutes Perforated PE | E-flutes Fine-pore film | E-flutes Fine-pore film Non-woven fabric | E-flutes Perforated PE(small) E-flutes Perforated PE(large) |
| Transmittance to Moisture of Packaging Material ($g/m^2 \cdot 24$ H) | 7.3 | 12 | 19 | 18 | 10.6 |
| Relative BL | 102 | 101 | 100 | 100 | 101 |

TABLE 1-continued

| | | Examples | | | | |
|---|---|---|---|---|---|---|
| Eample No. | | 1 | 2 | 3 | 4 | 5 |
| Embodiment No. | | 1 | 2 | 2 | 2 | 3 |
| Sensitivity | GL | 100 | 100 | 100 | 100 | 100 |
| | RL | 99 | 99 | 100 | 100 | 100 |
| Evaluation of Sensitivity | BL | • | ○ | ◎ | ◎ | ○ |
| | GL | ◎ | ◎ | ◎ | ◎ | ◎ |
| | RL | ○ | ○ | ◎ | ◎ | ◎ |
| Evaluation of Light-shielding Properties | | ○ | ○ | ◎ | ◎ | ○ |
| Surface as Arranged with a Pored film | | Periphery | Lateral side | Lateral side | Lateral side | Lateral side |
| Pore-area Ratio(%) in the pored Film | | — (Fine pore) | 80 | — (Fine pore) | — (Fine pore) | small:20 large:60 |

TABLE 2

| Comparative | | Comparative Examples | | | |
|---|---|---|---|---|---|
| Example No. | | 1 | 2 | 3 | 4 |
| Embodiment No. | | 2 | 2 | 1 | 3 |
| Materials Types of Packaging Materials | | E-Flutes LDPE | E-Flutes L-LDPE PET | LDPE L-LDPE | LDPE LDPE |
| Transmittance to Moisture of Packaging Material ($g/m^2 \cdot 24$ H) | | 2.7 | 3.1 | 1.04 | 2.1 |
| Relative Sensitivity | BL | 127 | 122 | 142 | 135 |
| | GL | 103 | 102 | 108 | 104 |
| | RL | 100 | 100 | 103 | 101 |
| Evaluation of Sensitivity | BL | X | X | X | X |
| | GL | Δ | • | x | Δ |
| | RL | ◎ | ◎ | Δ | ○ |
| Evaluation of Light-shielding Properties | | ◎ | ◎ | ◎ | ◎ |

In the above Tabes 1 and 2, the material types of the packaging material specify the types of the packaging materials surrounding the photosensitive material in its entirety, looking from the inner roll-shaped photosensitive material in the first embodiment, while specifying the types of the packaging material surrounding the lateral sides of the perforated film for a lateral side, looking from the inner roll-shaped photosensitive material in the second embodiment. In these Tables, E-flute, LDPE, L-LDPE, PET and perforated PE mean E-fluted corrugated board sheet, low-density polyethylene resin film, a polyethylene terephthalate film, and a perforated polyethylene resin film respectively. On the other hand, transmittance to moisture of the packaging material ($g/m^2 \cdot 24H$) means transmittance to moisture at a temperature of 40° C. and RH of 90% according to JIS Z-0208. The relative sensitivity and sensitivity evaluation specify the result of the relative sensitivity measurement test, while BL, GL and RL specify relative sensitivity of the blue-sensitive layer, green-sensitive layer and the red-sensitive layer, respectively. In the present Examples 1 to 5, the relative sensitivity was within the usable range for all of the blue-sensitive layer, green-sensitive layer and the red-sensitive layer, as shown in Table 1. Conversely, in the Comparative Examples 1 to 4, the relative sensitivity, especially that of the blue-sensitive layer, is significantly higher, even although the light-shielding performance is sufficient, as shown in Table 2, thus specifying that abnormal sensitization in photographic performance occurs to render the photosensitive material practically unusable. That is, if the packaged roll-shaped silver halide photosensitive material according to the present invention is used, it becomes possible to prevent deterioration with lapse of time of the silver halide photosensitive material due to abnormal sensitization in photographic performance. The results of Comparative Examples 5 and 6, in which the amounts of silver chloride in the silver halide photosensitive material are selected to be different from that in Comparative Example 3, are shown along with the results of the Comparative Example 3.

TABLE 3

| | | Comparative Example | | |
|---|---|---|---|---|
| Comparative Example No. | | 3 | 5 | 6 |
| Material Types of Packaging Materials | | | LDPE | |
| Amount of Silver Chloride in Photosensitive Material(mol %) | | 97 | 80 | 25 |
| Transmittance to Moisture of Packaging ($g/m^2 \cdot 24$ H) | | | 1.04 | |
| Relative Sensitivity | BL | 142 | 117 | 105 |
| | GL | 108 | 105 | 101 |
| | RL | 103 | 101 | 100 |
| Evaluation Sensitivity | BL | X | X | Δ |
| | GL | X | Δ | ○ |
| | RL | Δ | ○ | ◎ |
| Evaluation of Light-Shielding Properties | | ◎ | ◎ | ◎ |

It is seen that, in Comparative Examples 3, 5 and 6, although abnormal sensitization in photographic performance occurs in the Comparative Examples 3, 5 and 6 to render the photosensitive materials unusable, relative sensitivity is lowered with decreased concentration of silver chloride to lower the degree of reductive sensitization. That is, with increased silver chloride density in the silver halide photosensitive material, the proportion of reductive sensitization by long-term storage is increased, that is, the packaged roll-shaped silver halide photosensitive material according to the present invention is particularly effective for a silver halide photosensitive material containing silver chloride.

On the other hand, with the Examples 2 to 4 of the second embodiment, employing an E-flute corrugated board sheet capable of increasing the transmittance to moisture and absorbing impact from the lateral side, prevention of abnormal sensitization in photographic performance and protection of the packaged roll-shaped silver halide photosensitive material can be achieved simultaneously. In addition, in Examples 2, 3 and 5, deterioration in the E-fluted corrugated board sheet or deterioration in quality of the roll-shaped silver halide photosensitive material due to intrusion of rain water can be prevented by the outermost polyethylene resin film (water proof film).

For example, in the Example 5, a transparent water proof film is arranged on the perforated film, and this is packaged in the manner not to affect the transmittance to moisture and does not seal up.

According to the present invention, it is possible to transmit the reducing materials, such as sulfur, antiseptics, hydrogen generating substances (such as aluminum compounds), present in a gaseous phase in the packaged roll-shaped silver halide photosensitive material and contained in the substrate or in the photosensitive layer, to outside in order to prevent the density of the reducing substances in the packaged photosensitive materials from being increased to prevent deterioration of the roll-shaped silver halide photosensitive material, in particular the silver halide photosensitive material containing silver chloride, due to abnormal sensitization in the photographic performance.

As many apparently widely different embodiments of the present invention can be made without departing from the spirit and scope thereof, it is to be understood that the invention is not limited to the specific embodiments thereof except as described in the appended claims.

What is claimed is:

1. A packaged roll-shaped silver halide photosensitive material comprising a winding core, a roll-shaped silver halide photosensitive material wound on said winding core and having a periphery and two lateral sides, a packaging material covering the periphery and both of the two lateral sides of said roll-shaped silver halide photosensitive material, wherein the periphery and the two lateral sides represent three surfaces, and wherein at least one surface of the three surfaces or a portion thereof is packaged with a packaging material comprising a combination of a paper material with a pored film comprising a film having pores, and said packaging material comprising a combination of a paper material with said pored film having a water vapor permeability of not less than 5.1 $g/m^2 \cdot 24$ hours, wherein said water vapor permeability is measured at a temperature of 40° C. and 90% humidity, and wherein said pored film is a perforated film.

2. The packaged roll-shaped silver halide photosensitive material as defined in claim 1, wherein said perforated film is on the lateral sides of the roll-shaped silver halide photosensitive material.

3. The packaged roll-shaped silver halide photosensitive material as defined in claim 1, wherein the perforated film has a pore-area ratio of 20 to 80% of the film.

4. The packaged roll-shaped silver halide photosensitive material as defined in claim 1, wherein said roll-shaped silver halide photosensitive material has a width along the winding core of not less than 50 cm and a winding diameter of not less than 30 cm.

5. The packaged roll-shaped silver halide photosensitive material as defined in claim 1, wherein said pored film contains one or more light-shielding materials, and in the periphery or the two lateral sides that have no pored film, said silver halide photographic material is packaged by films that have complete light-shielding ability.

6. A packaged roll-shaped silver halide photosensitive material comprising a winding core, a roll-shaped silver halide photosensitive material wound on said winding core and having a periphery and two lateral sides, a packaging material covering the periphery and both of the two lateral sides of said roll-shaped silver halide photosensitive material, wherein the periphery and the two lateral sides represent three surfaces, and wherein at least one surface of the three surfaces or a portion thereof is packaged with a packaging material comprising a combination of a paper material with a pored film comprising a film having pores, and said packaging material comprising a combination of a paper material with said pored film having a water vapor permeability of not less than 5.1 $g/m^2 \cdot 24$ hours, wherein said water vapor permeability is measured at a temperature of 40° C. and 90% humidity, and wherein said paper material is a corrugated board sheet.

7. The packaged roll-shaped silver halide photosensitive material as defined in claim 6, wherein said corrugated board sheet is on the lateral sides of the roll-shaped silver halide photosensitive material.

8. The packaged roll-shaped silver halide photosensitive material as defined in claim 6, wherein said pored film is one or more films selected from the group consisting of fine-pore films and perforated films, and a pore-area ratio of the perforated film is 20 to 80% of the film, and wherein the fine-pore films have a pore size of from 0.01 to 50 $\mu$m.

9. The packaged roll-shaped silver halide photosensitive material as defined in claim 6, wherein said roll-shaped silver halide photosensitive material has a width along the winding core of not less than 50 cm and a winding diameter of not less than 30 cm.

10. The packaged roll-shaped silver halide photosensitive material as defined in claim 6, wherein said pored film contains one or more light-shielding materials, and in the periphery or the two lateral sides that have no pored film, said silver halide photographic material is packaged by films that have complete light-shielding ability.

11. A packaged roll-shaped silver halide photosensitive material comprising a winding core, a roll-shaped silver halide photosensitive material wound on said winding core and having a periphery and two lateral sides, a packaging material covering the periphery and both of the two lateral sides of said roll-shaped silver halide photosensitive material, wherein the periphery and the two lateral sides represent three surfaces, and wherein at least one surface of the three surfaces or a portion thereof is packaged with a packaging material comprising a combination of a paper material with a pored film comprising a film having pores, and said packaging material comprising a combination of a paper material with said pored film having a water vapor permeability of not less than 5.1 $g/m^2 \cdot 24$ hours, wherein said water vapor permeability is measured at a temperature of 40° C. and 90% humidity, and wherein said combination of the paper material with the pored film is a combination of a corrugated board sheet with at least one of a perforated film and a fine-pore film having a pore size of from 0.01 to 50 $\mu$m disposed on the lateral sides of the roll-shaped silver halide photosensitive material.

12. The packaged roll-shaped silver halide photosensitive material as defined in claim 11, wherein the perforated film has a pore-area ratio of 20 to 80% of the film.

13. The packaged roll-shaped silver halide photosensitive material as defined in claim 11, wherein said roll-shaped silver halide photosensitive material has a width along the winding core of not less than 50 cm and a winding diameter of not less than 30 cm.

14. The packaged roll-shaped silver halide photosensitive material as defined in claim 11, wherein said pored film contains one or more light-shielding materials, and in the periphery that has no pored film, said silver halide photographic material is packaged by films that have complete light-shielding ability.

* * * * *